US005938099A

United States Patent [19]

Ciccarelli

[11] Patent Number: 5,938,099

[45] Date of Patent: Aug. 17, 1999

[54] REBAR CLIP GUN

[76] Inventor: Mark A. Ciccarelli, 26664 Seagull Dr. Suite #B110, Malibu, Calif. 90265

[21] Appl. No.: 08/934,603

[22] Filed: Sep. 22, 1997

Related U.S. Application Data

[63] Continuation-in-part of application No. 08/850,005, May 1, 1997.

[51] Int. Cl.[6] ..... B21D 7/06

[52] U.S. Cl. ..... 227/19; 227/8; 227/120; 29/243.56

[58] Field of Search ..... 227/19, 8, 2, 4, 227/120, 130; 29/243.56

[56] References Cited

U.S. PATENT DOCUMENTS

| | | | |
|---|---|---|---|
| 721,434 | 2/1903 | Edeburn | 29/243.56 |
| 1,451,717 | 4/1923 | Sommer | 29/243.56 |
| 2,923,008 | 2/1960 | Ingram | 29/243.56 |
| 3,810,495 | 5/1974 | Pack | 29/243.56 |
| 3,945,238 | 3/1976 | Eckert | 29/243.56 |
| 4,003,118 | 1/1977 | Jensen | 29/243.56 |
| 4,169,307 | 10/1979 | Weinzimer et al. | 29/243.56 |
| 5,020,355 | 6/1991 | Payne et al. | 29/243.56 |
| 5,709,124 | 1/1998 | Murayama | 29/243.56 |

*Primary Examiner*—Scott A. Smith
*Attorney, Agent, or Firm*—John J. Murphey

[57] ABSTRACT

A machine for applying a metal wire clip to intersecting first and second tubular elements arranged in vertical and horizontal configuration, comprising a machine housing, a handle extending from the housing and a trigger pivotally arranged for operable movement toward and away from handle, a first mechanism for feeding wire clips, one-at-a-time, into the machine housing for forming the clips into a U-shaped clip element defined by a central concave bight area and a pair of legs extending substantially mutually parallel and outward from the bight area; a second mechanism for moving the clip element out of the machine housing and into contact with the first tubular element, and a third mechanism for deforming the legs upward about the second horizontal tubular element to clasp both first and second tubular elements together.

68 Claims, 17 Drawing Sheets

REBAR CLIP GUN

RELATION TO OTHER APPLICATIONS

This is a Continuation-in-Part Patent Application of my previously filed Application, Titled REBAR CLIP GUN WITH SPOOLED OR STACKED STEEL REBAR CLIPS BENT TO AFFIX AND LOCK REBAR MEMBERS, Filed May 1, 1997, and given Application No. 08/850,005 pending.

BACKGROUND OF THE INVENTION

1. Field of the Invention

This invention pertains to the field of tooling. More particularly, this invention pertains to hand tools and to a powered hand tool for applying wire ties or clips to the intersections of tubular elements, such as concrete rebars and the like, so that the rebar structure becomes tightly bound together before concrete is poured thereover.

2. Description of the Prior Art

Man has been building large structures throughout history. First came the monolithic structures such as the famous heads of Easter Island. Later came the pyramids and the Great China Wall. All of these structures were made of individual pieces of natural stone that were carefully cut and modified to fit tightly together as a whole structure.

These structures required many persons and many days, weeks, months and, in some cases, years of work to complete. Even then, earth quakes and general settling of the earth caused many of these structures to sag and/or collapse. These structural failings were mainly caused by the inability of the structure to retain its structural integrity on the shifting earth.

It is believed that the Greeks and Romans first discovered concrete. Concrete is a mixture of sand and gravel bonded together with cement. Cement is the product of burnt lime and clay. By adding water to the mixture, it may be made fluid and poured into a form or mold to take many shapes.

In the early 1900's, it was discovered that if one placed a very strong matrix inside a molded structure of cement, then any load from the exterior of the structure was passed through the cement to the matrix. This was exemplified by erecting strong steel bars inside a form and then pouring concrete over the bars. The final structure, known as "steel reinforced concrete" was able to withstand loads many times greater than the loads that would cause failure to non-reinforced concrete.

The patent history of reinforced steel concrete can be gauged by the issuance of patents for improvements in the reinforcing structures. For instance, U.S. Pat. No. 1,637,742 discloses the use of metal "chairs" at points of intersection of the steel reinforcing rods, called "rebars". This tying together of the rebars improved the overall integrity of the matrix and increased the load stability of the final concrete structure.

U.S. Pat. Nos. 1,816,833; 2,298,104; 3,16:3,266; 4,005,560; 4,388,791; 4,939,883; and, British Patent 589,447 all disclose physically applied metal wires or clips to rebar structures to enhance the overall integrity of the reinforcing matrix to produce a stronger concrete structure. There are some items of interest in this history. For instance, all these patents disclose wire ties and clips that are physically tied to the rebars. There are no patents that discuss welding the rebars together at their points of intersection. The reason is that welding changes the hardness and other physical properties of the rebars in the area of the weld and those changed physical properties are quite detrimental to the loadbearing quality of the overall structure.

While tying the rebars together takes wire, it is common to use the word "clip" when discussing ties that are made of strong wire. In this patent application, the inventor has chosen the word "clip" to mean the metal wire that is wound about the rebar to connect two or more rebars together as they pass in tangential contact with each other.

Typical of the wire clips disclosed in the patents is U.S. Pat. No. 4,388,791 that discloses a clip that is applied by hand to the intersection of rebars in the structure and that is able to be loosened by tilting upward to partially remove the legs of the clip from the overlapping rebars. All the patents set out above disclose rebar clips that are applied by hand. This is a very arduous and time-consuming process. In addition, it is costly because of all the manual labor expended by those who cut, shape, apply, and twist the clips about the intersecting rebars to form the connection therebetween. Up to the present, there has not been a machine nor other appliance developed that would allow the wire clips to be applied to the intersections of the rebars using other than hand power.

SUMMARY OF THE INVENTION

This invention is a machine or gun that takes at least one wire clip, either in straight sections or as a pre-formed element, and places it about the intersection of crossed tubular elements and forms the tie into a clip that captures the contacted elements in a tight clasp. The operation is done quickly and can be repeated rapidly with the machine so that the rebar structure can be fashioned in record time.

In its broadest terms, this invention is a hand-held machine for applying a metal clip to intersecting first and second tubular elements arranged in vertical and horizontal configuration, comprising a machine housing, a handle extending from the housing and a trigger, a first means for feeding wire sections, one-at-a-time, into the machine housing for forming them into U-shaped clips defined by a central concave bight area and a pair of legs extending substantially mutually parallel and outward from the bight area, a second means for moving the clip out of the machine housing and into contact with the first tubular element, and a third means for deforming the legs about the second horizontal tubular element to clasp both first and second tubular elements tightly together.

In a second embodiment of the invention, there are two third means, one spaced-apart from the other, and the machine is modified to accept two clips. The two third means are then used to wrap two U-shaped clips about the tubular elements to make a stronger connection therebetween.

Accordingly, the main object of this invention is a machine that applies wire clips to rebar structures faster and more accurately than manually applied clips heretofore. Other objects of the invention include a hand-held machine that uses power from outside sources instead of manual power; a machine that can place clips at points of intersection of rebars and other tubular elements such that the clipped areas may be used to climb on later by the workmen; a machine that can place wire clips on rebar structures using less skilled labor than now required; a machine that will take the place of numerous workmen and thereby drive down the cost of construction of reinforced concrete structures; and, a machine that may be handled by a robot and programmed to place the clips on a rebar structure and make many such structures without human intervention.

These and other objects of the invention may be determined by reading the description of the preferred embodiments along with the drawings attached hereto. The scope of protection sought by the inventor may be gleaned from a fair reading of the claims that conclude this specification.

DESCRIPTION OF THE PREFERRED EMBODIMENTS

Figure 1:
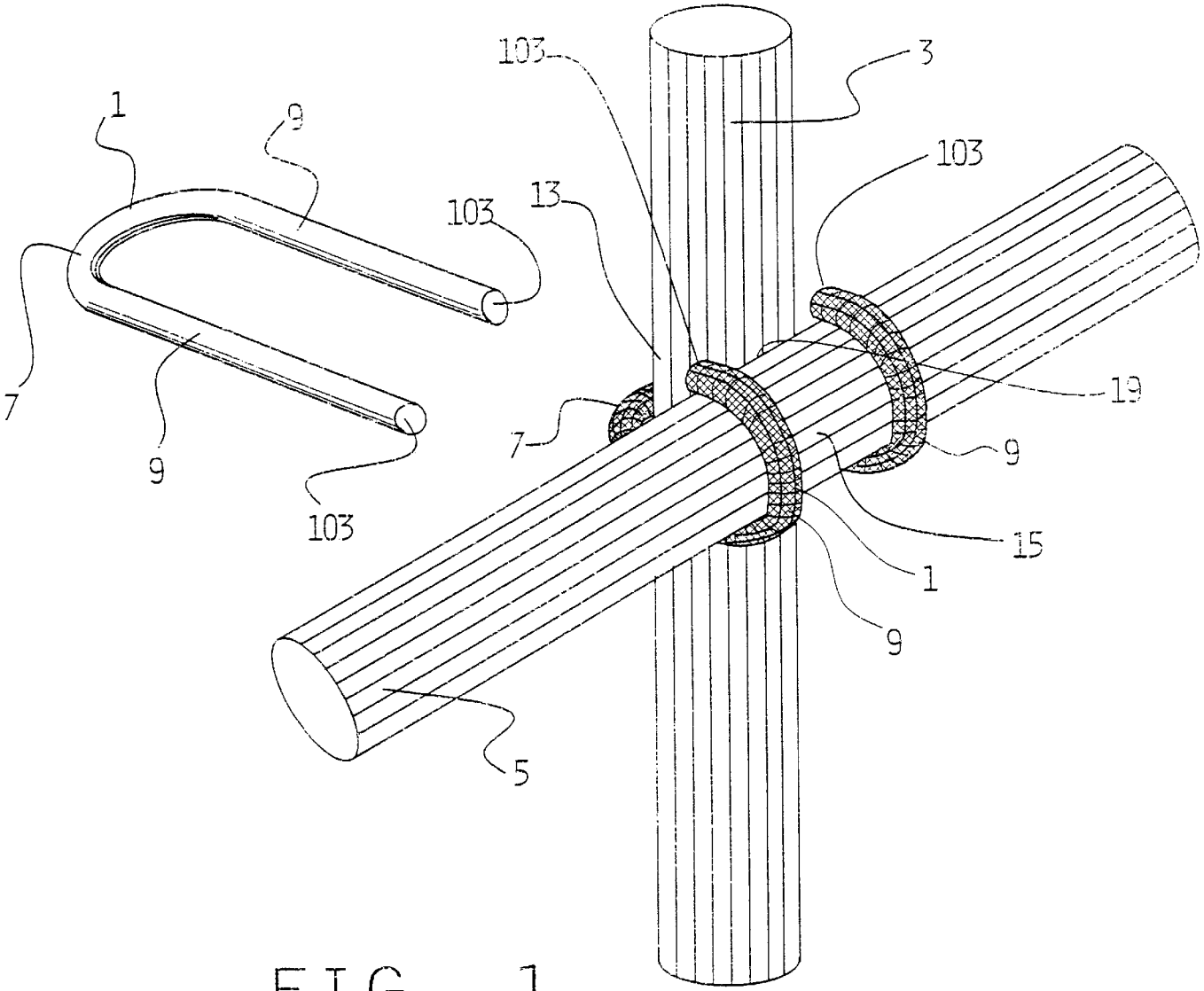
FIG. 1 is an illustrative view of first and second tubular elements that meet in vertical and horizontal intersection and a clip, useful with this invention, for clasping them tightly together.

Turning now to the drawings where elements are identified by numbers and like elements are identified by like numbers throughout the 18 figures, the object of this invention is to place a clip 1 about intersecting first and second tubular elements 3 and 5 as shown in FIG. 1. Clip 1 is defined by a central concave bight area 7 and a pair of legs 9 extending substantially mutually parallel and outward from bight area 7. First and second tubular elements 3 and 5 are arranged in vertical and horizontal configuration respectively where first element 3 is arranged vertically and second element 5 is arranged horizontally behind first element 3 so that clip 1 is centered about the posterior surface 13 of vertical first element 3 and the extremities or legs 9 of clip 1 are wrapped about the anterior surface 15 of horizontal second element 5.

Figure 2:
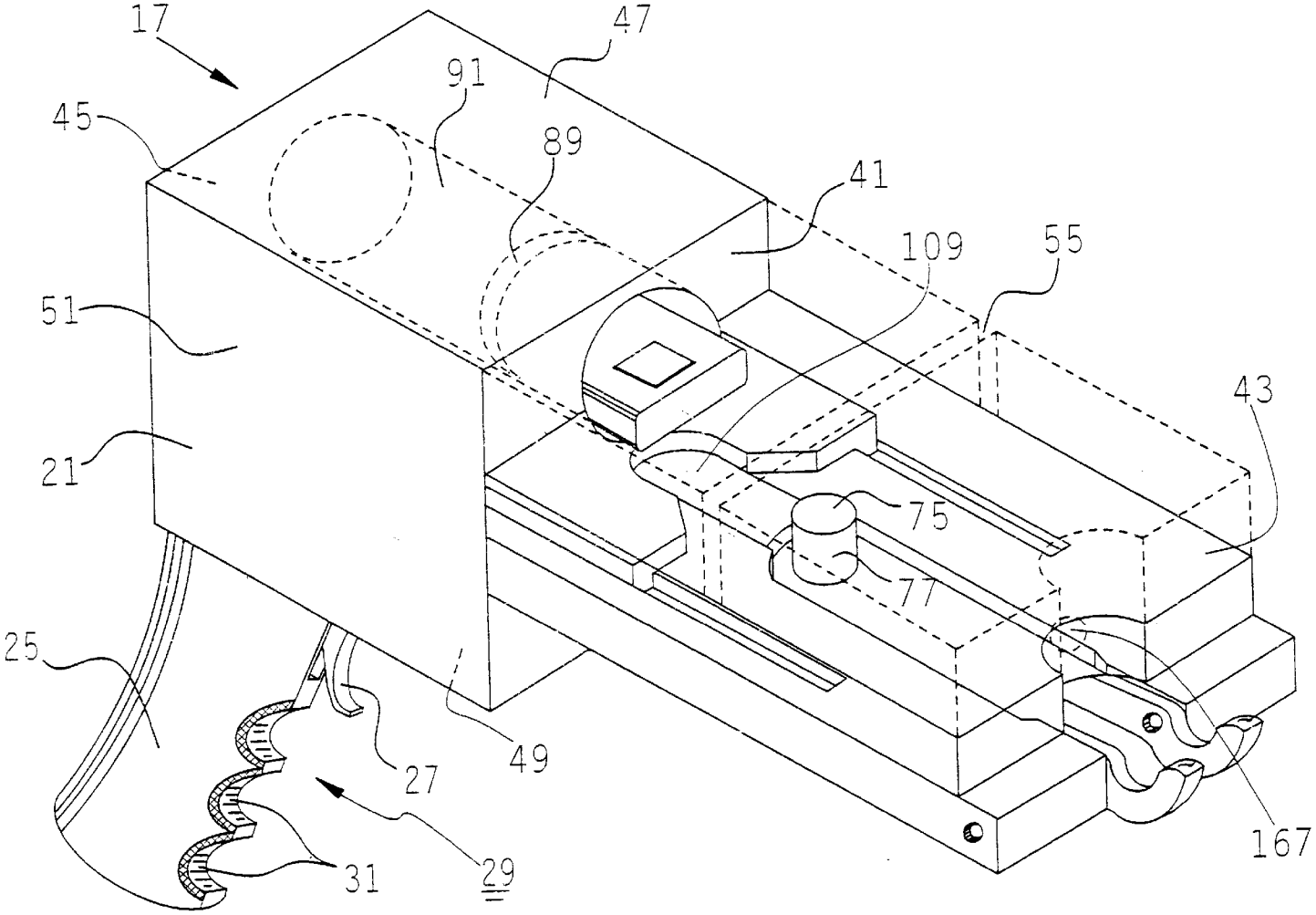
FIG. 2 is a perspective view of one of the preferred embodiments of this invention.

As shown in FIG. 2, the hand-held machine 17 of this invention is used to apply clip 1 about the intersection 19 of first and second tubular elements 3 and 5, respectively. In overall design, inventive machine 17 is shown in FIG. 2 to comprise a machine housing 21, a handle 25 extending from housing 21, and a trigger 27.

Figure 3:
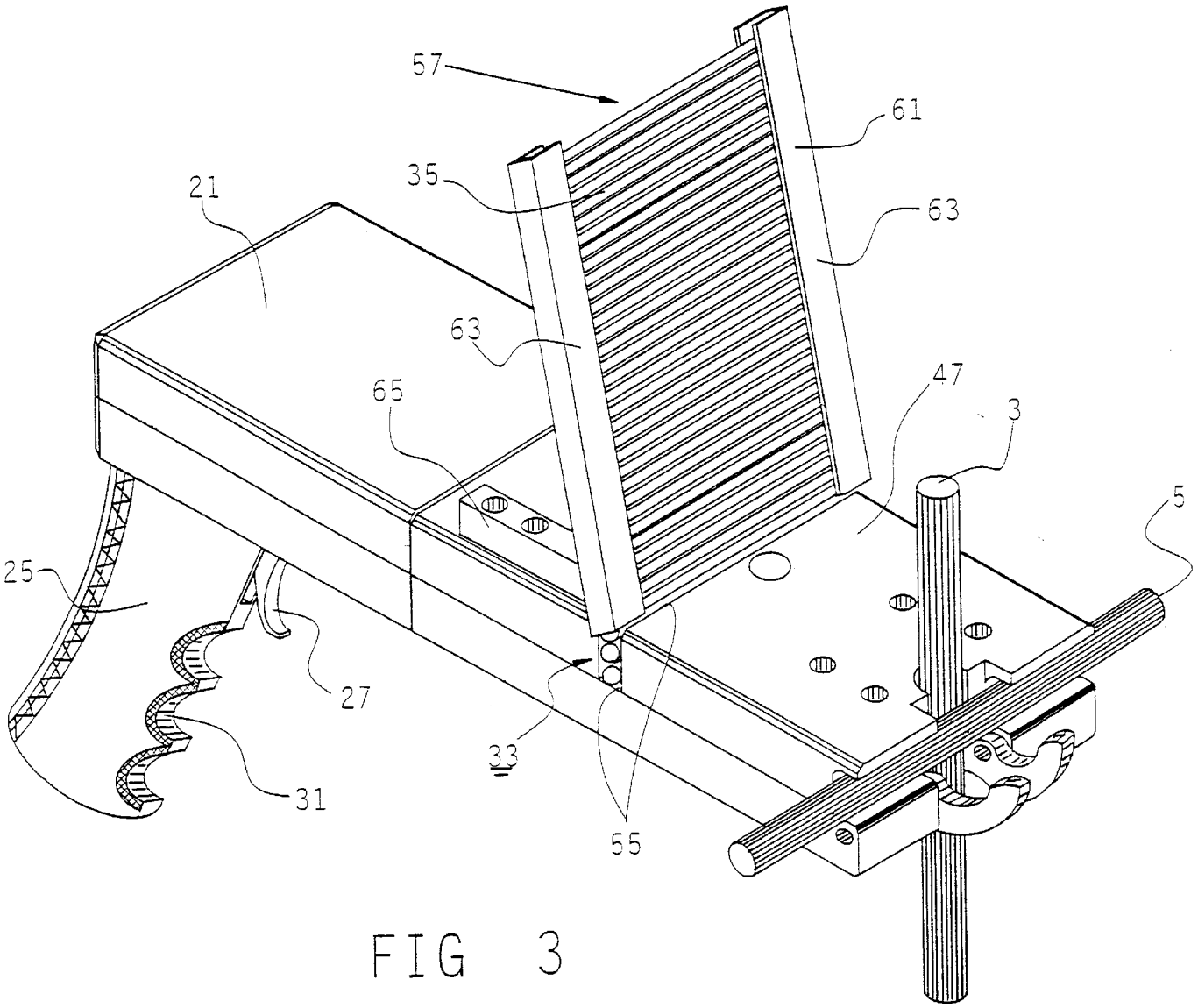
FIG. 3 is a perspective view of one of the preferred embodiments of this invention showing a magazine for holding a plurality of straight wires for feeding to the machine.
Figure 4:
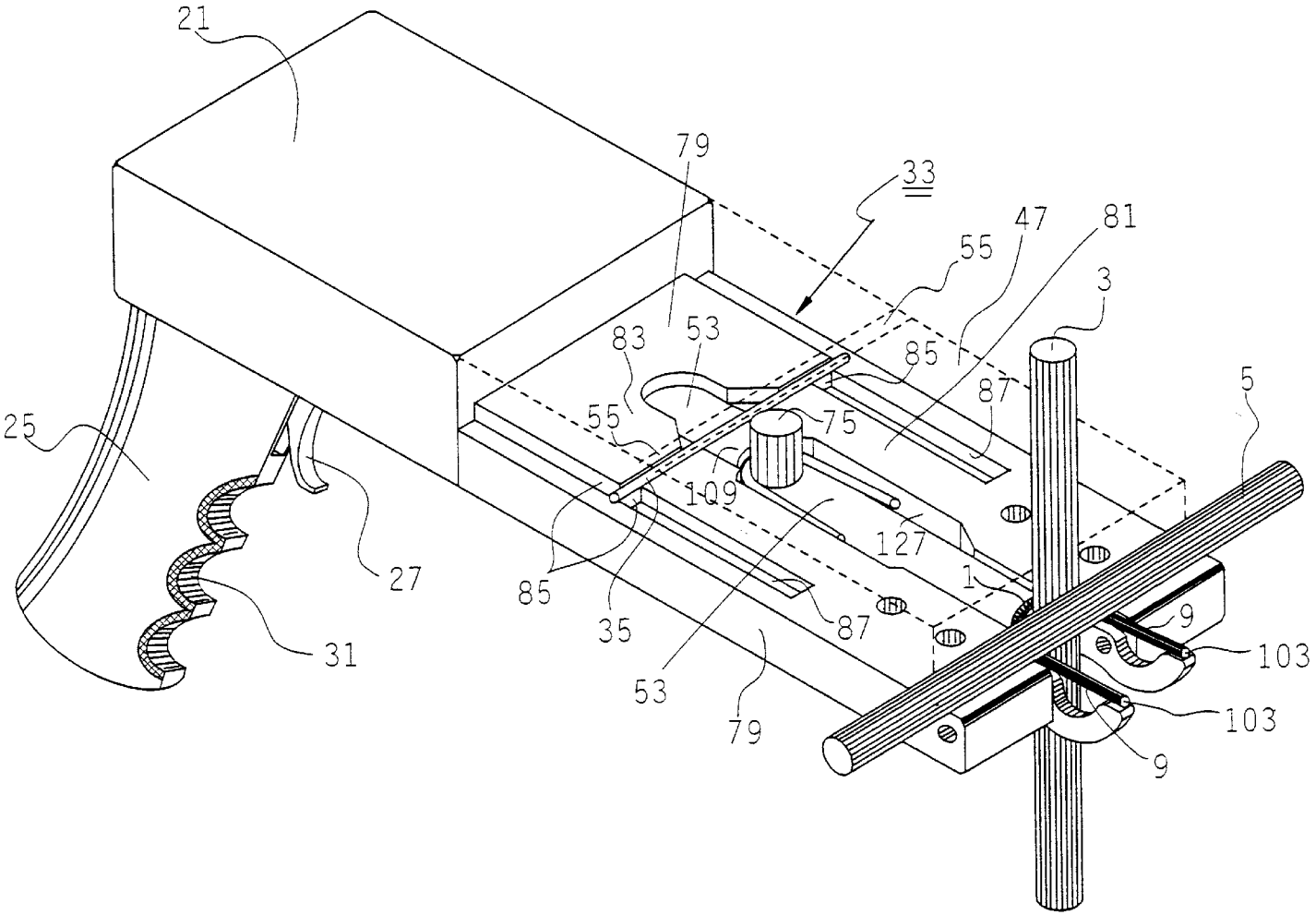
FIG. 4 is a perspective view of the embodiment shown in FIG. 3 showing some of the internal parts of the machine such as the relationship between the upper wire bending site and the lower charging site into which the clip falls following bending.

Hand-held machine 17 is small and light enough to be manipulated by one hand. As shown in FIGS. 2–4, pistol-grip type handle 25 extends downward and away from machine housing 21 so that machine 17 is balanced above handle 21 when in use. Handle 25 includes a first means 29 for steadying machine housing 21 during use. As shown, first means 29 includes a series of depressions 31 formed in the front surface of handle 25 for partial receipt therein of portions of the user's fingers when holding the machine. Trigger 27 of machine 17 is pivotally mounted to handle 25 for operative movement by a finger of the hand that holds the machine during use.

Figure 5:
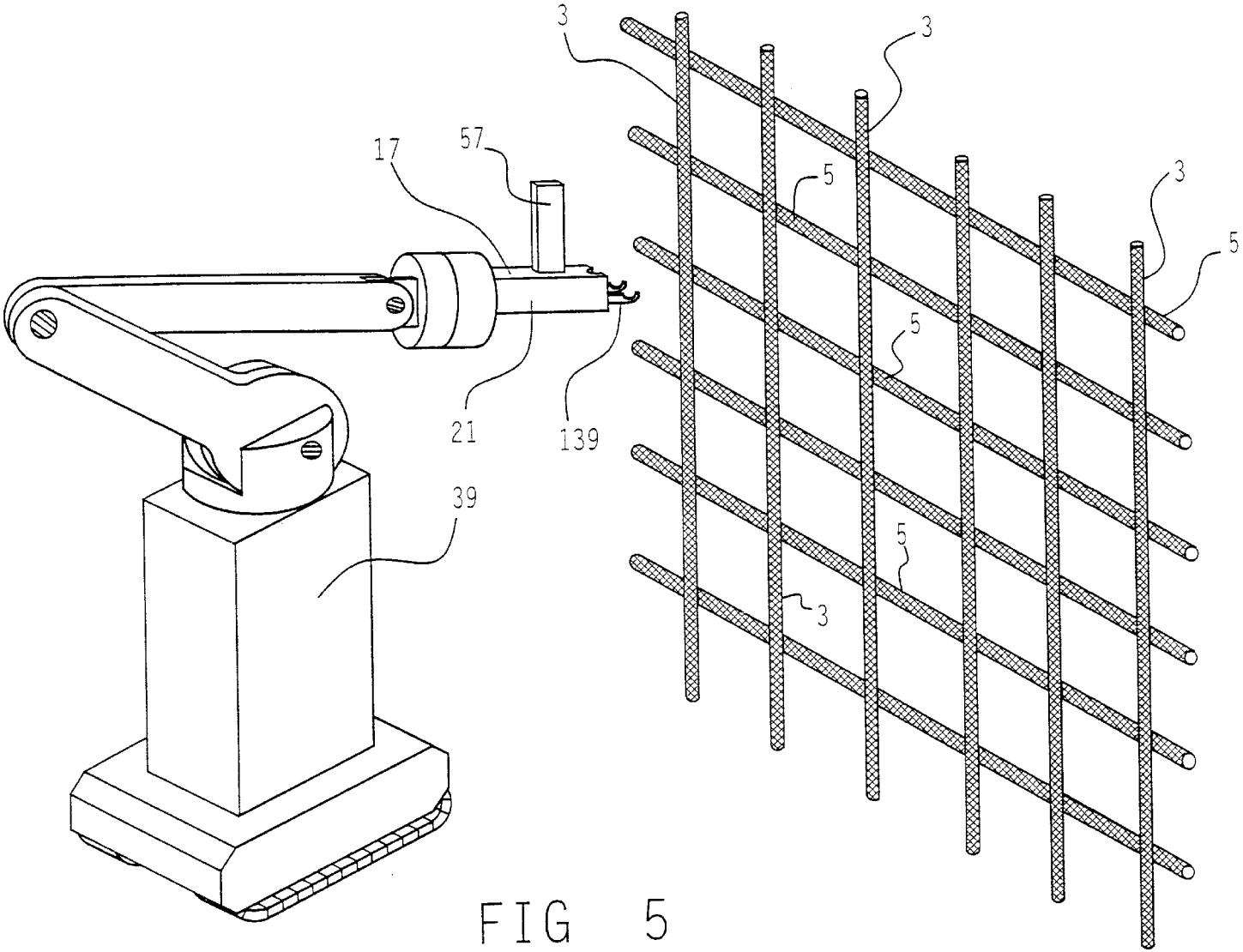
FIG. 5 is an illustrative view of a robot utilizing this invention to clip together vertical and horizontal rebars at their intersecting points.

As shown in FIGS. 3 and 4, a second means 33 is provided for feeding sections of straight wires 35, one-at-a-time, into said machine housing 21 for deforming them at a bending site into U-shaped clips 1. FIG. 5 shows this inventive machine 17 held in an extension arm of a robot 39 which is approaching a vertical rebar 3 having a plurality of horizontal rebars 5 in contact therewith for clipping them together using a program (not shown) housed in a computer (also not shown) mounted inside the robot.

More specifically, FIGS. 2–4 show the hand-held machine 17 of this invention for applying metal clips 1 to intersecting first and second tubular elements 3 and 5 that are arranged in vertical and horizontal configuration to comprise machine housing 21 surrounded by front and rear surfaces 43 and 45 respectively, held in spacedapart arrangement by a pair of spaced-apart top and bottom surfaces 47 and 49 respectively, and further covered by a pair of spaced-apart side panels 51. It is preferred that machine housing 21 be made of strong material, such as aluminum or composite plastic, to incorporate the bores and pistons hereinafter described and sustain the rough usage that a tool of this type will normally undergo during its useful life.

Handle 25 extends downward and rearwardly from housing 21, preferably at an angle thereto, and trigger 27 is preferably located at the front of handle 25 and at the top thereof, to be operable by the index finger of the hand holding machine 17 during use.

As shown in FIGS. 3 and 4, second means 33, for feeding short straight sections of wire 35 one-at-a-time, to a bending site 53, internal machine housing 21, and includes a slot 55 in machine top surface 47 for receipt therethrough of the straight sections of wire 35 into bending site 53. To aid in presenting a plurality of wires for deformation into clips 1 for use in machine 17, a magazine 57 is provided, as shown in FIG. 3, having a plurality of wires 35 loaded therein in usable order.

As shown in FIG. 3, magazine 57 comprises a magazine housing 61 in which a plurality of short sections of straight wires 35 are loaded in a common plane and held therein by a pair of spaced-apart magazine sides 63 and said magazine 57 held in operable position against machine housing top panel 47 by brackets 65 as shown. Other types of magazines 57 are contemplated in this invention.

Figure 6A:
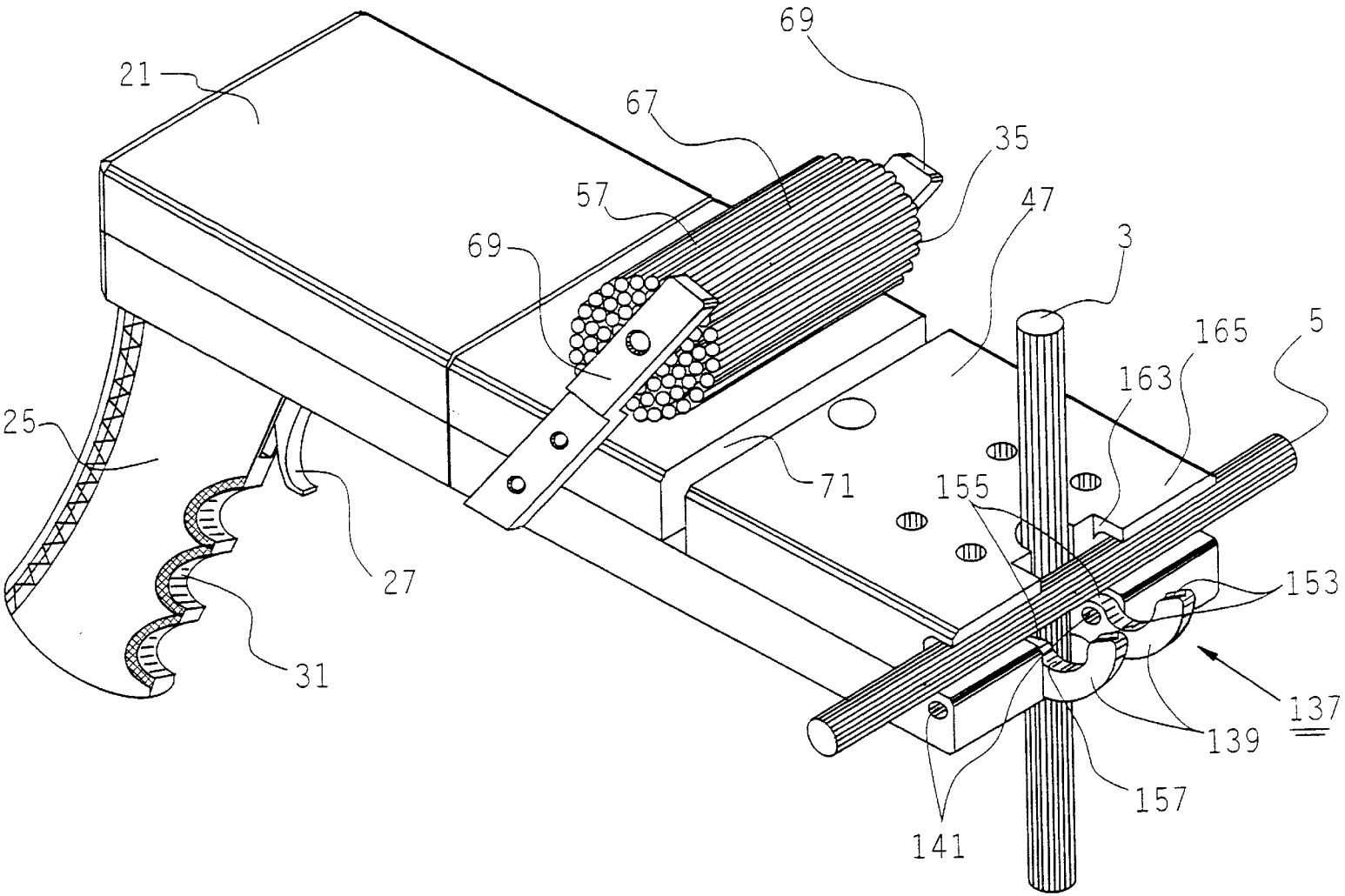
FIG. 6*a* is perspective view of the preferred embodiment of the invention showing another type of magazine for holding a plurality of straight wires for feeding to the machine.

FIG. 6*a* shows another type of magazine 57 in which a roll 67 of short, straight sections of wires 35 are held in a tangential mat-like format said roll 67 supported above machine housing top surface 47 by a pair of brackets 69. As each clip is fed in through a slot 71 in housing top surface 47, roll 67 unwinds slightly to continue to provide a fresh, short segment of wires 35 to be utilized.

Figure 7:
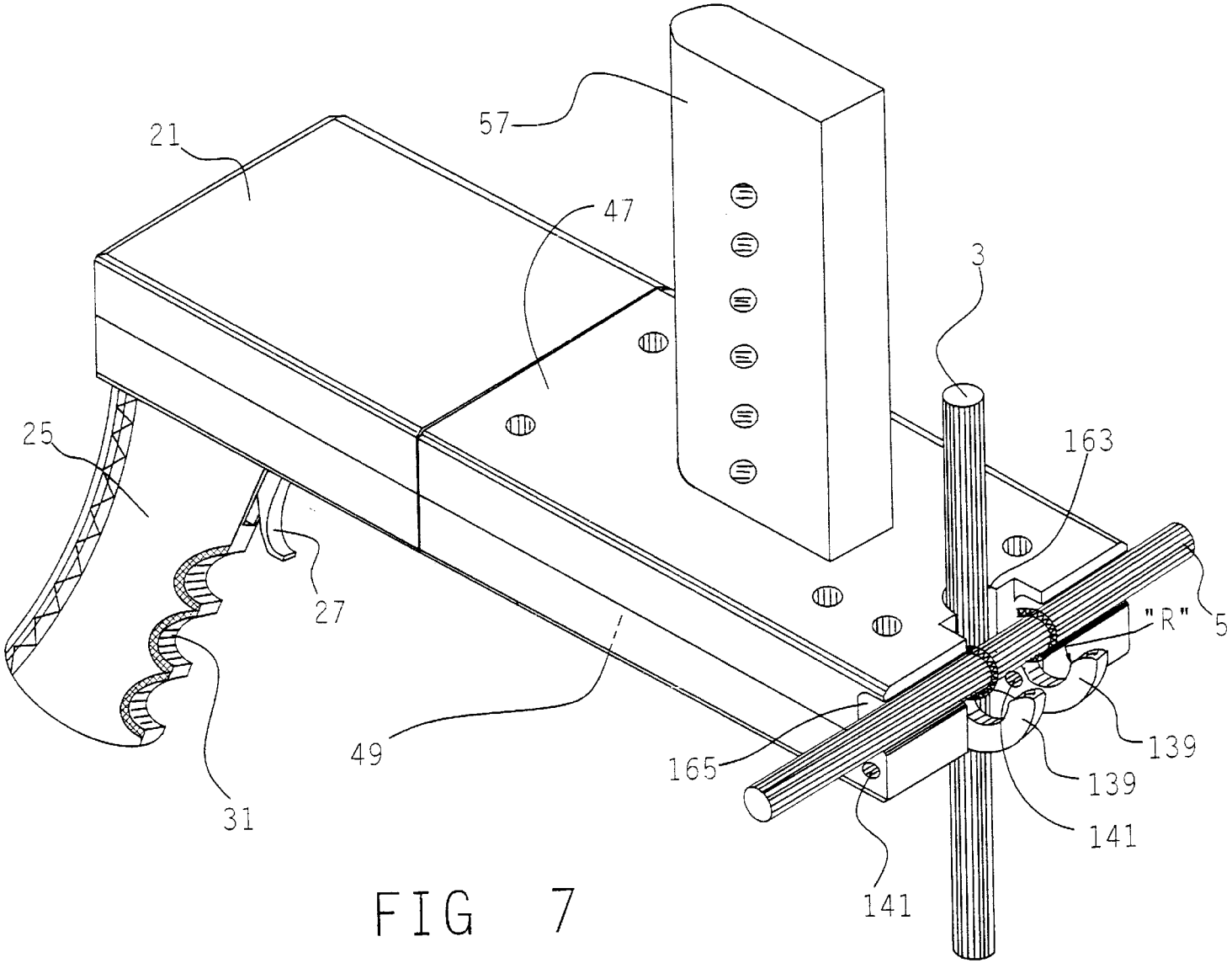
FIG. 7 is a perspective view of one of the preferred embodiments of the invention showing another type of magazine for holding a plurality of pre-formed U-shaped clips for feeding to the machine.
Figure 8:
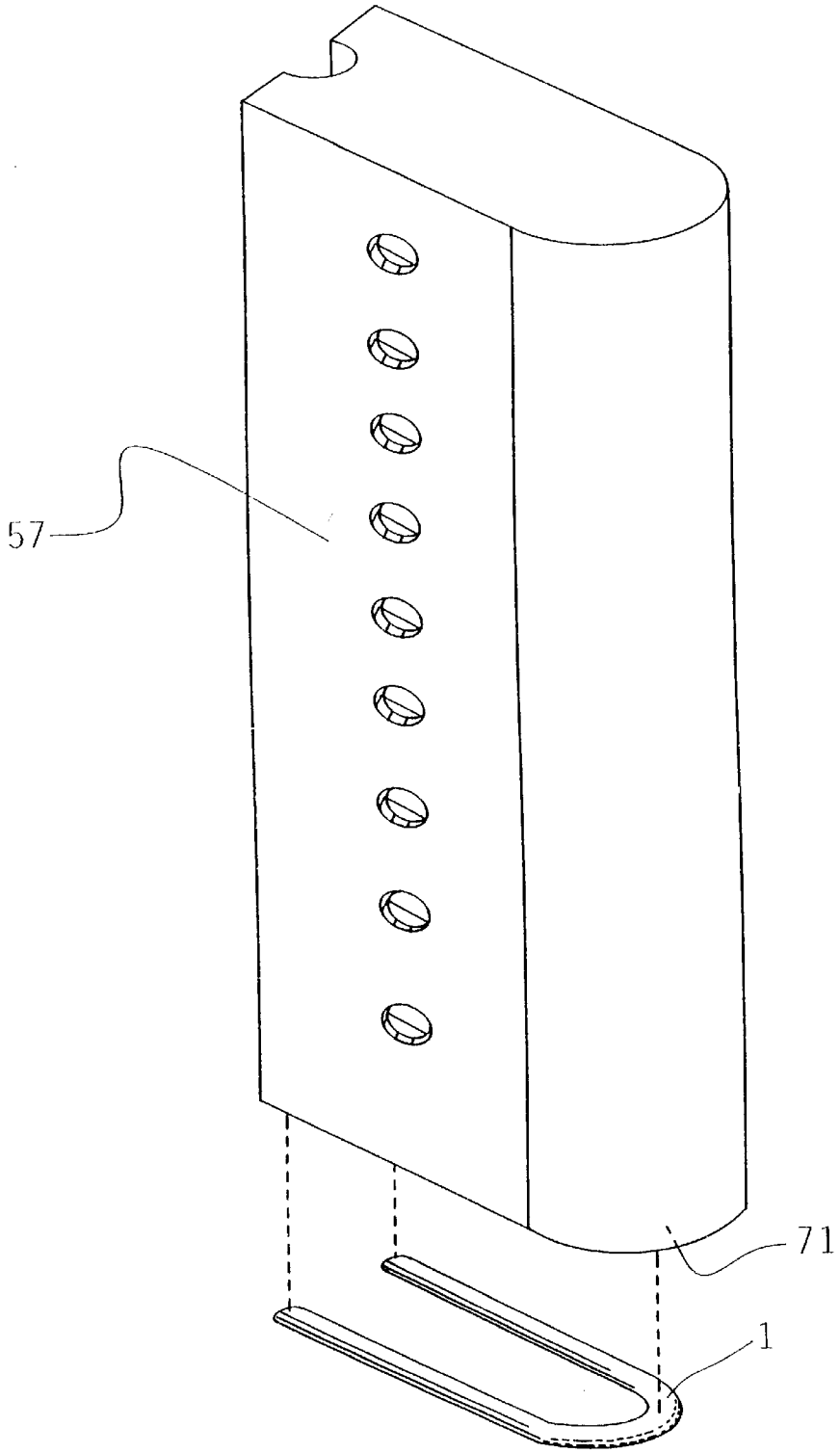
FIG. 8 is a perspective view of the magazine of the type used in the embodiment shown in FIG. 7 and showing a pre-formed U-shaped clip removed from the end of the magazine.

FIGS. 7 and 8 show another magazine 57, this time feeding fully developed U-shaped clips 1 into machine housing 21 through an opening (not shown) located in machine top surface 47. FIG. 7 shows this magazine 57 and a clip 1 extracted through magazine bottom 71, already inthe deformed, U-shaped configuration. This embodiment of magazine 57 uses spring power (not shown) under the inventory of clips 1 in the magazine to force them out through bottom 71 thereof, similar to that encountered in a bullet clip in a semi-automatic pistol. In addition, this embodiment of clip 1 is already pre-bent into the U-shape formation and does not have to pass through bending site 39 so that it may be ignored. As shown, magazines 57 may be temporarily attached to machine housing 21 at top surface 47, or at a side panel 51, or at bottom panel 49, and all of these configurations are fully contemplated in this invention.

As shown in FIG. 4, bending site 53 is formed in machine housing 21, between side panels 51 and under top surface 47, and includes a mandrel 75 having an outer forming surface 77 the size and shape of central bight area 7 formed in clip 1. It is preferred that mandrel 75 be mounted in housing 19 and hung or suspended from under top surface or panel 45 to be able to hang down into bending site 53.

Figure 9:
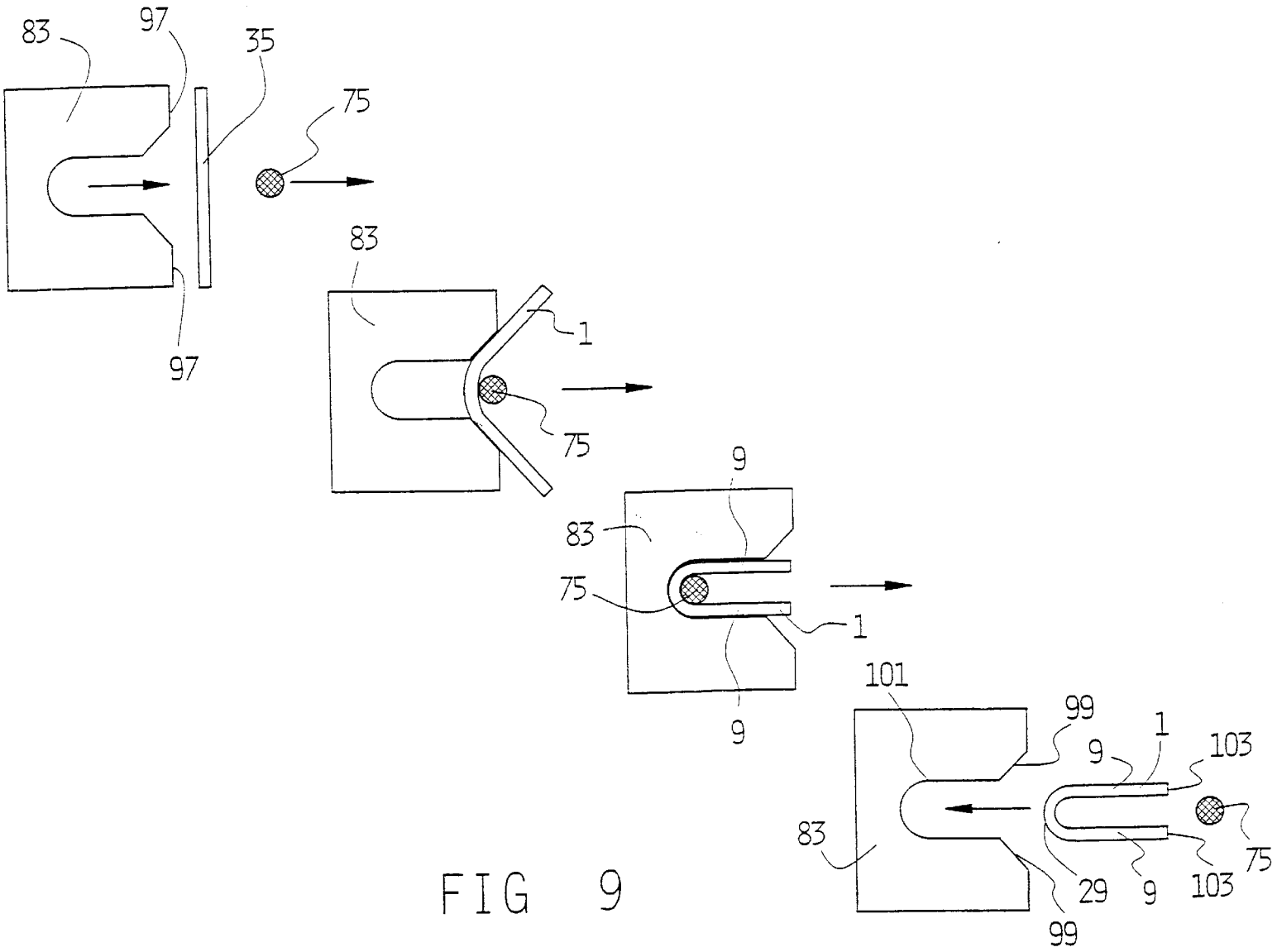
FIG. 9 is a series of four steps showing the forming die to cooperatively engage the mandrel to form a piece of straight metal wire into a U-shaped clip usable in this invention.

At bending site 53 there is a die body 79, preferably contained within machine housing 21 on which a planar die surface 81 is formed on the top thereof. As shown in FIG. 9, a forming die 83 is reciprocally mounted on die surface 81 and adapted to move on shoes 85 riding in parallel channels 87, formed in die surface 81, into and out of cooperative engagement with mandrel 75, to deform sections of wires 35 from their initial straight form into their useful U-shaped configuration 1. This is accomplished by having forming die 83 move in reciprocal motion against mandrel 75 while wire 35, in its straight form, is captured therebetween on die surface 81. It is preferred that forming die 83 be powered by a piston 89 (see FIG. 2) that is housed for reciprocal movement in a bore 91 formed in machine housing 21.

It is further preferred that a return means, such as spring 93 (see FIGS. 11 and 16), be attached between piston 89 and the far or bottom end 95 of bore 91 so that when power, such as in the form of compressed air, high pressure hydraulic fluid or electricity, is removed from the driver of piston 89, spring 93 will draw piston 89 deep into bore 91 and simultaneously withdraw forming die 83 from its cooperative engagement with mandrel 75 to free U-shaped clip 1 for further motion.

It is preferred that forming die 83 be of a thickness equal to or very slightly greater than the thickness of straight clip 1 so that only one clip enters through slot 55 to reside on die surface 81 at any one time. Forming die 83 is therefore a controller of the number (one-at-a-time) of straight wires 35 that are admitted to bending site 53 at any one time.

Forming die 83 contains a plurality of forming surfaces for sequential contact with straight wire 35 in bending site 53 during the deforming of the wire into its U-shaped form. As shown in FIG. 9, included in this plurality of forming surfaces is a pair of first aligned surfaces 97 that are arranged substantially parallel to the main axis of straight wire 35 and located in spaced-apart arrangement on both sides of mandrel 75. They are arranged to simultaneously contact straight clip 1 and begin to deform it at its center to begin forming center bight area 7.

Because of difficulty in forming a straight wire segment into a perfect U-shape in one pass of a die, a pair of second surfaces 99 are formed on forming die 83 and are located inboard from first surfaces 97. Second surfaces 99 are inclined at an angle to the main axis of wire 35, on both sides of the center bight area 7, and are arranged for simultaneous contact with the wire on both sides of center area 7, after partial deformation of wire 35 by first surfaces 97, as shown in FIG. 9.

A third forming surface 101, located at the center of forming die 83, is arranged to make final contact with partially deformed wire 35 to form center bight area 7 as shown in FIG. 9. Thus produced is a substantially U-shaped clip 1 where, because of the springing action of the metal used in clip 1, legs 9, while generally parallel, are slightly spread as they proceed from center bight area 7 to their respective distal ends 103.

A third means 105 is provided for moving clip 1 out of bending site 53 in machine housing 21 and into contact with first and second tubular elements 3 and 5.

Figure 10:
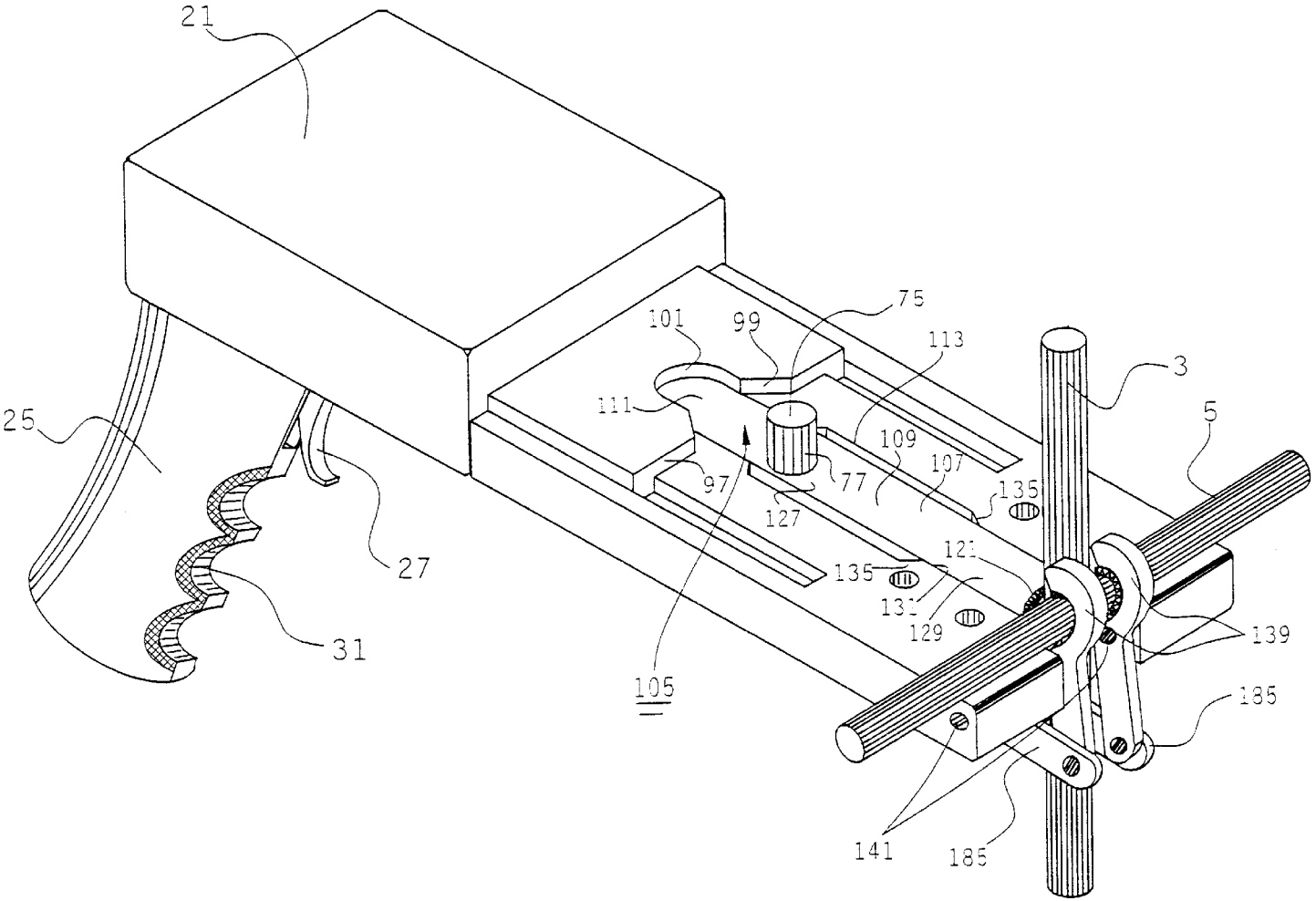
FIG. 10 is a perspective view of one of the preferred embodiments of the invention showing the mandrel, the forming die, the charging bar and the position of the bending forks after they have bent the legs of the clips about the anterior surface of a horizontal tubular element.

As shown in FIGS. 4 and 10, in this preferred embodiment, third means 105 includes a charging site 107 formed immediately below bending site 53 and separated therefrom by a charging bar 109. Charging bar 109 is a generally flattened, of the thickness of a clip 1 so that only one clip may repose in the charging site at any one time. Further, charging bar 109 has a smooth top surface 111 that is parallel and planar with die surface 81 and forms part of the surface of die surface 81. Further, charging bar 109 is reciprocally mounted in a channel 113 for rectilinear movement therein. It is preferred that charging bar 109 be powered by a piston 115 (see FIG. 11) that is housed in a bore 117 formed in machine housing 21. It is further preferred that a return means, such as spring 119, be attached between piston 115 and the far end 121 of bore 117 so that when power, such as in the form of compressed air, high pressure hydraulic fluid or electricity, is removed from the driver of piston 115, spring 119 will draw piston 115 deep into bore 117 and simultaneously withdraw charging bar 109 from its forward position.

Figure 15A:
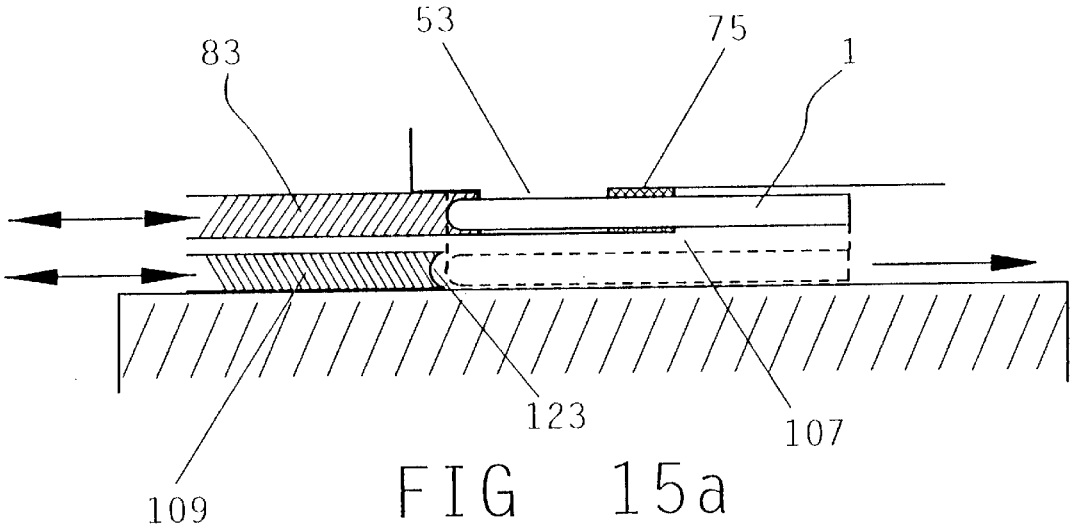
FIG. 15*a* is a side view of the bending site and charging site of the single clip embodiment shown in FIG. 2.
Figure 15B:
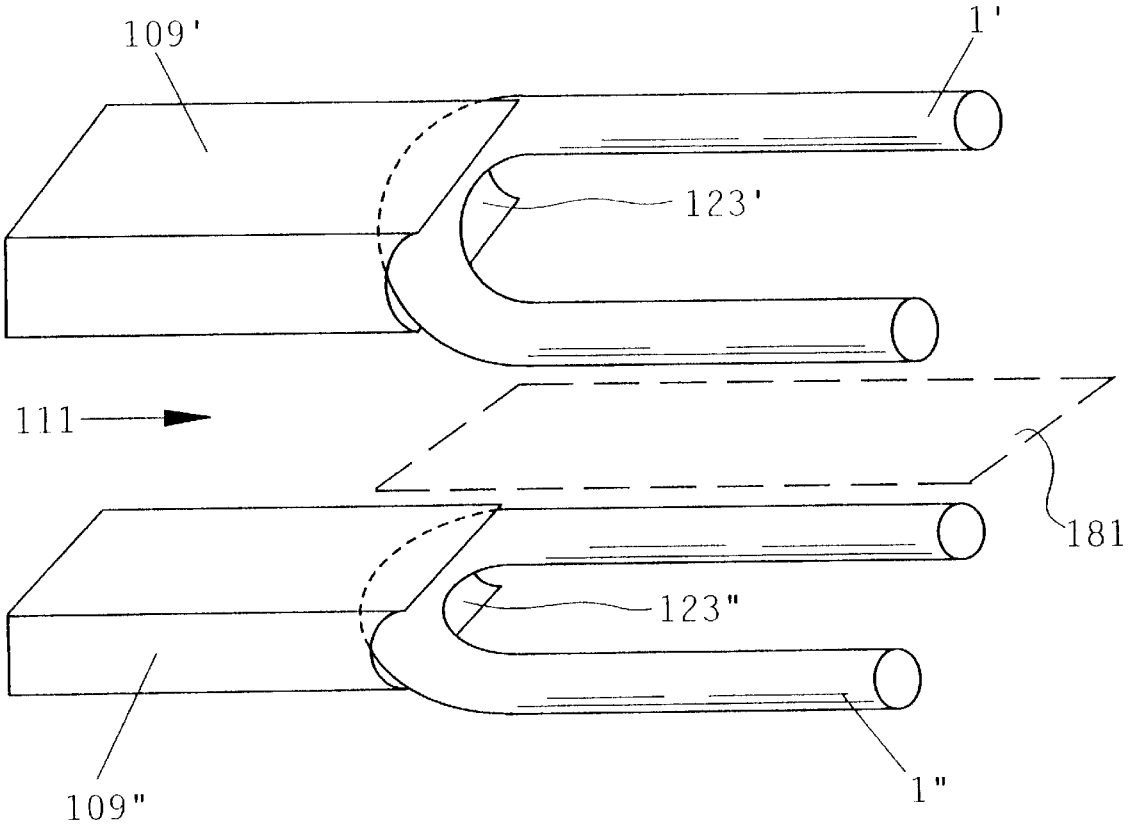
FIG. 15*b* is a side view of the upper and lower charging sites in the double clip embodiment shown in FIG. 13; and, FIG. 16 is a side view, partially in section of the double clip embodiment shown in FIG. 13 showing the action of the pistons, the charging bars and the two pairs of bending forks.

As shown in FIGS. 15*a* and 15*b*, at the forward end of charging bar 109 is formed a face 123 that conforms to the outside surface of central bight area 7, and arranged to contact said bight area 7 and move U-shaped clip 1 from charging site 107 inside housing 21 forward and outward through an aperture 125, formed in front housing surface 43, into contact with posterior surface 13 of first tubular element 3.

It is preferred that bores 91 and 117 be formed parallel in machine housing 21. This arrangement allows respective pistons 89 and 115 to move in rectilinear paths that are parallel to each other and deliver maximum power to the formation of U-shaped clip 1 and to the charging of U-shaped clip 1 into contact with the posterior surface 13 of first tubular element 3.

Charging bar 109 is arranged for movement rearward from under bending site 53 after clip 1 has been formed by forming die 83 and mandrel 75. This allows clip 1 to drop by gravity from bending site 53 downward into charging site 107. Then, charging bar 109 is driven forward by piston 115, to move clip 1 into contact with posterior surface 13 of first vertical tubular element 3. Bending site 53 once again is emptied and is of a depth equal to the width of straight wire 35 so that only one of said wires may drop down from magazine 57 at a time, by gravity or by gravity aided by spring bias, through slot 55 into bending site 53 for the next deforming operation.

As previously mentioned, legs 9 of U-shaped clip 1 do not come into a pure parallel U-shape due to the yieldability of the metal making up clip 1. Therefore, newly deformed U-shaped clip 1 has its legs 9 diverging outward slightly from center bight area 7. To prevent this slight divergence from causing clip 1 from hanging up in its movement by gravity from bending site 53 downward into charging site 107, charging site 107 is defined by opposed, spaced-apart side walls 127 that include a first area 129, under bending site 53, wherein said side walls 127 are spaced wider apart than the width of channel 113. Thus, there is greater side room for clip 1 to drop down into so that hang-ups are eliminated.

As shown in FIGS. 4 and 10, a second area 131 is created, adjacent first area 129 and located between first area 129 and aperture 125, whose side walls 133 divert at 135 or curve back into channel 113 at a gradual angle to slightly squeeze the legs of newly deformed U-shaped clip 1 toward each other and further into parallelism on their way through the rest of channel 113 and into contact with posterior surface 13 of first vertically oriented tubular element 3.

A fourth means 137 is provided for deforming legs 9 upward about second horizontal tubular element 5 to clasp both first and second tubular elements 3 and 5 together as shown in FIG. 1. Fourth means 137, for deforming legs 9 upward about the anterior surface 13 of second tubular element 5, preferably includes a pair of bending forks 139 pivotally mounted on a split pin 141 located in or exterior to machine housing front surface 43 as shown in FIGS. 2–4, 6, 7, and 10. Forks 139 and pins 141 are arranged in spaced-apart configuration, one on each side of aperture 125 and are adapted to rotate upward toward machine housing top panel 47. Forks 139 may be adjustable on pins 141 to pass along the opposite sides of vertical rebars of different diameters.

Figure 11:
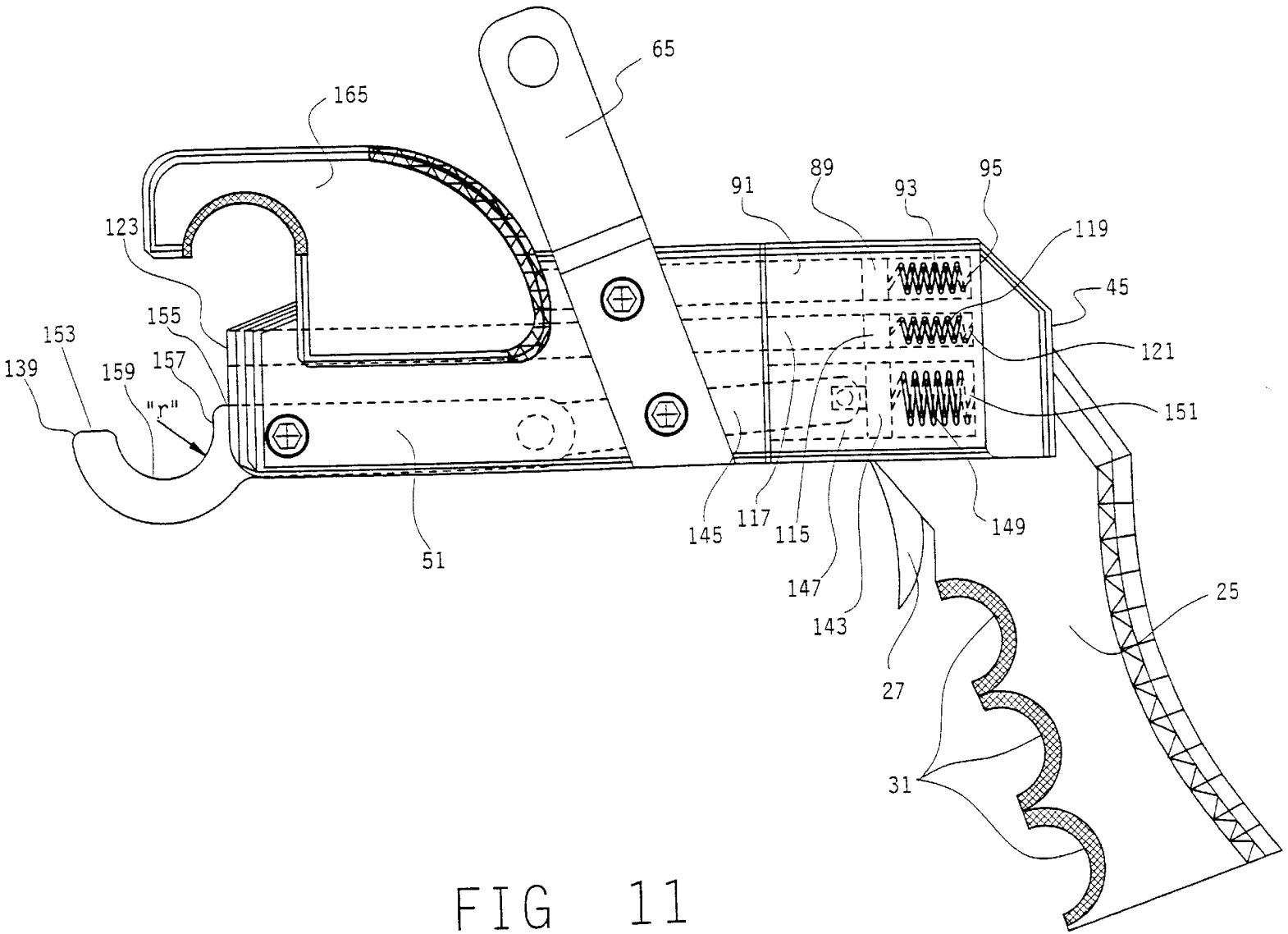
FIG. 11 is a side view of another embodiment of the invention showing the hangers that may be used to steady the machine against the horizontal tubular elements during application of the clip to the tubular elements and the location of the pistons and cylinders inside the machine housing.

As shown in FIGS. 10 and 11, forks 139 are adapted to pivot about pin 141, upward, one on each side of the first vertical tubular element 3, and deform legs 9 of clip 1 about the anterior surface 13 of second, horizontal tubular element 5. This pivoting action is preferred to be powered by a piston 143 that is interconnected to forks 139 by one or more links 145, said piston 143 being housed in a bore 147 formed in machine housing 21 and adapted to stroke forward to activate forks 139. It is further preferred that a return spring 149 be attached between piston 143 and the far end 151 of bore 147 so that when power, such as in the form of compressed air, high pressure hydraulic fluid or electricity, is removed from the driver of piston 143, at the end of its stroke, spring 149 will draw piston 143 deep into bore 147 and simultaneously withdraw bending forks 139 to their original position as shown in FIG. 7.

It is preferred that bores 117 and 147 be formed parallel in machine housing 21. This arrangement allows respective pistons 115 and 143 to move in rectilinear paths that are parallel to each other and deliver maximum power to the deformation of clip legs 9 about the anterior surface 15 of second tubular element 5.

It is further preferred that all three bores 91, 117 and 147 be formed parallel to each other in machine housing 21. This arrangement allows respective pistons 89, 115 and 143 to all move in rectilinear paths that are parallel to each other and deliver maximum power to the handling of clip 1, including the deformation of straight wire 35 into U-shaped clip 1, the charging of U-shaped clip 1 against posterior surface 7 of first element 3, and the bending of clip legs 9 about the anterior surface 15 of second tubular element 5.

As shown in FIGS. 6*a* and 11, bending forks 139 are defined by first and second distal ends 153 and 155 respectively, and have an action surface 157 formed thereon. Action surface 157 comprises a centrally located arcuate saddle 159 of a radius "r" that is preferably the same radius as the outside radius of second tubular element 5. Arcuate saddle 159 is arranged to come into full contact with posterior surface 13 of second tubular element 5 during the pivotal movement of fork 139 as it bends clip leg 9 about second tubular element 5.

Figure 6B:
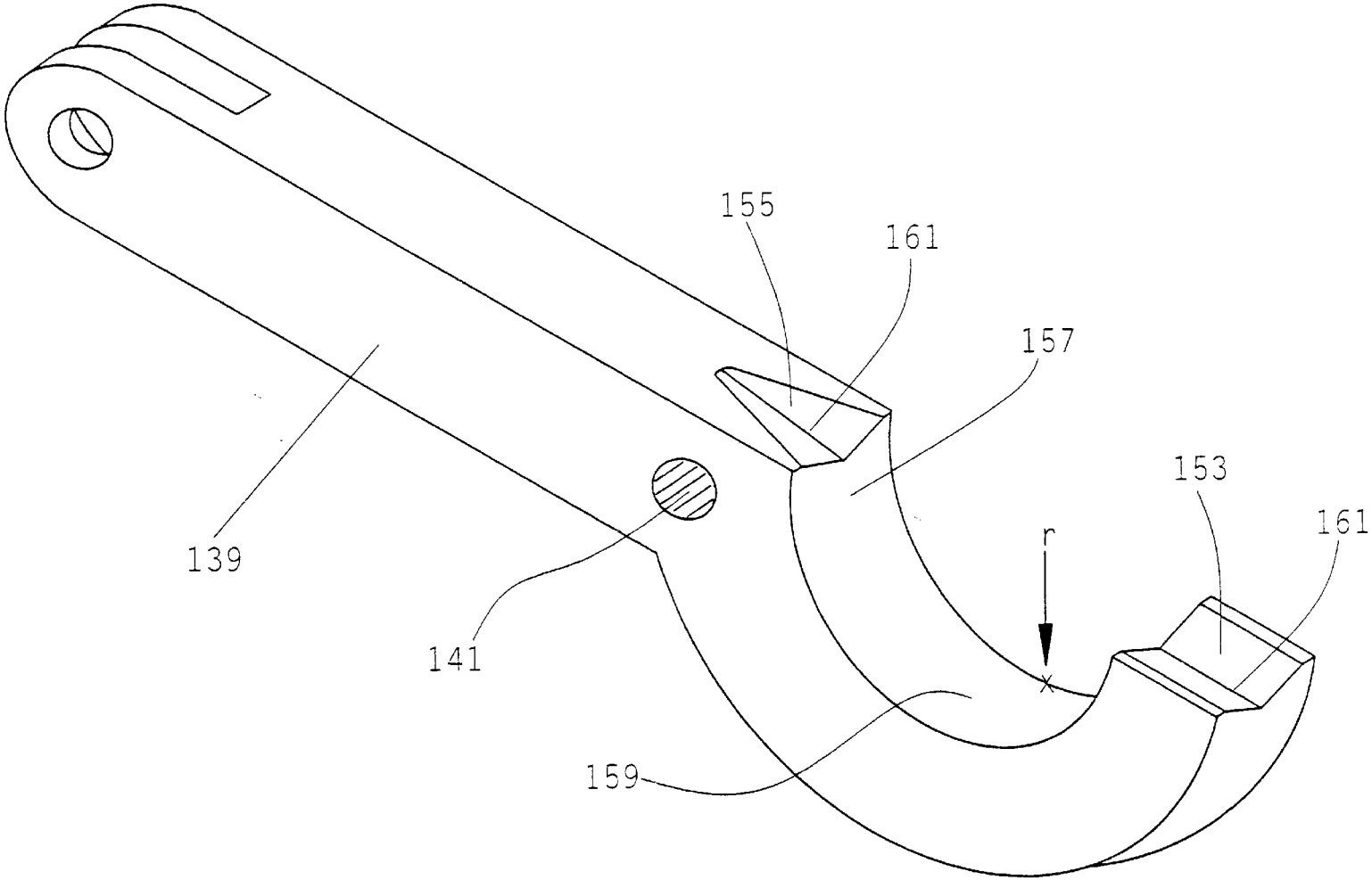
FIG. 6*b* is an illustrative view of a bending fork isolated from the rest of the machinery.

In operation, clip 1 is forced out of machine housing 21 from charging site 107 through aperture 125 by movement of charging bar 109 along channel 113 to bring central bight area 7 thereof into contact with posterior surface 13 of vertical rebar 3 and clip legs 9 on opposite sides of vertical tubular element 3. As clip 1 moves into contact with first tubular element 3, legs 9 are directed first across distal end 155, then across arcuate saddle 159 then onto second distal end 153 as shown in FIGS. 4 and 11. Simultaneously, by correctly aiming machine 17, legs 9 are properly directed to pass under second tubular element 5. Thereafter, while central bight area 7 of clip 1 is pressed by charging bar 109 tightly against posterior surface 13 of first tubular element 3, power is applied to piston 143 to drive bending forks 139 about pin 141 to deform legs 9 about the anterior surface 13 of horizontal tubular element 5 as shown in FIG. 10. Legs 9 are caused to be bent about the anterior surface and, depending upon their length, leg distal ends 103 may terminate tangentially on the anterior surface of second tubular element 5 or extend across the surface and terminate above said anterior surface. To aid in retaining legs 9 centrally on first and second distal ends 153 and 155, it is preferred to form single small depressions 161 longitudinally along said distal ends as shown in FIG. 6*b*.

In order to aid the user in centering machine 17 against first tubular element 3, FIG. 7 shows a vertical indented area 163 and a horizontal indented area 165 formed in housing front surface 43, for temporary receipt therein of the whole of first tubular element 3 and the whole of horizontal tubular element 5. In addition, in order to relieve hand strain in using the machine of this invention, it may be preferable to provide a pair of hangers 165 for temporarily hanging over horizontal second tubular element 5 as shown in FIG. 11.

An exposed depressible pin 167 is located in indent area 163, said pin connected by various known means to the power-driven section of hand-held machine 17 to provide a means of retaining machine 17 in a locked and "safe" condition. Machine 17 will only become unlocked and ready for action when pin 167 is pressed against first vertical tubular element 3, and trigger 27 depressed. This way the machine of this invention will be rendered safe for handling at all times.

Figure 12:
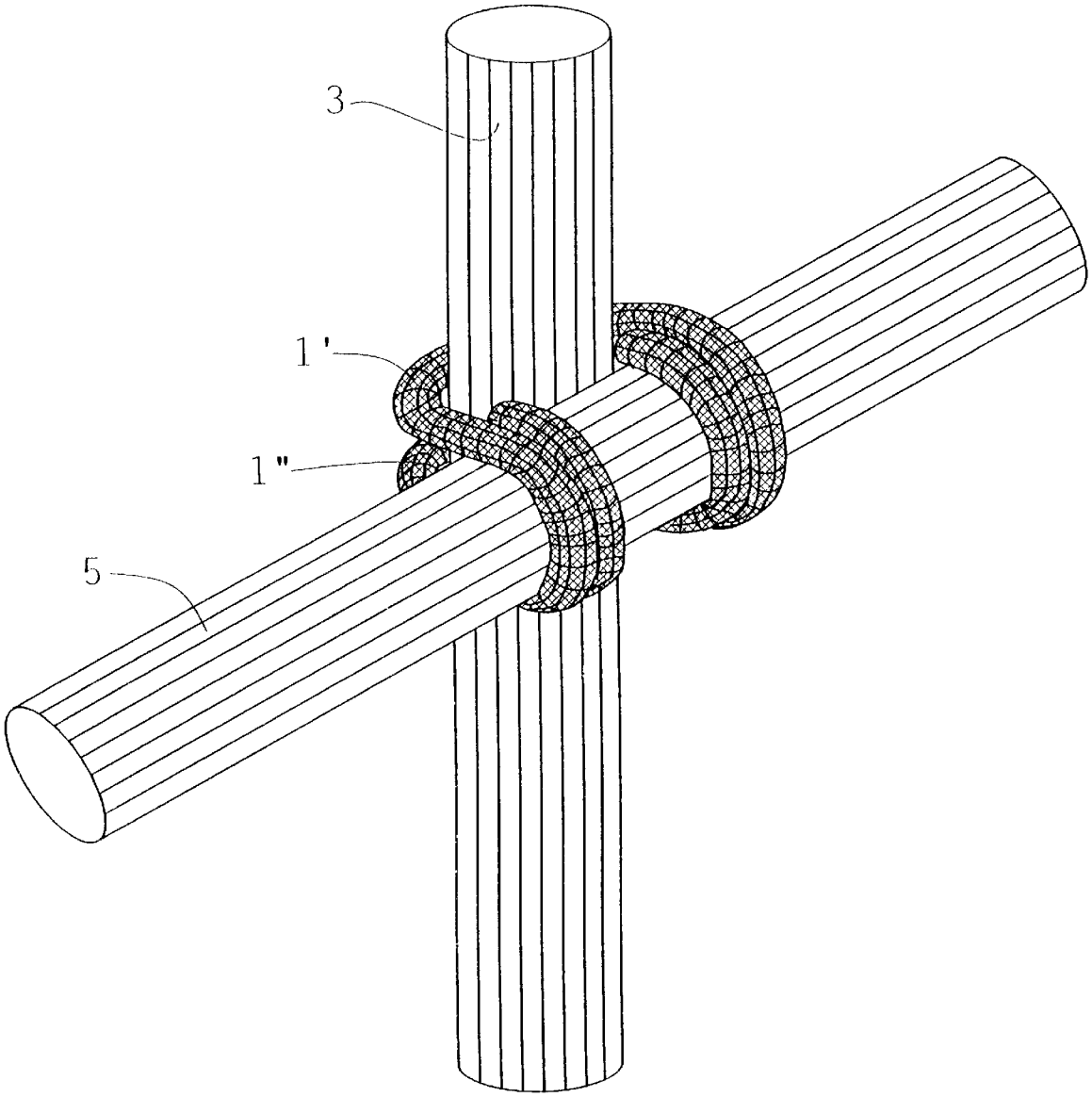
FIG. 12 is an illustrative view of a pair of intersecting tubular members held together by two clips that have been applied by a second preferred embodiment of this invention.

In another embodiment of this invention, two clips 1 and 1', in spaced-apart arrangement, are bent or formed about intersecting first and second tubular elements 3 and 5 arranged in vertical and horizontal configuration that captures the contacted elements in a tight clasp. This is shown in FIG. 12 where a first clip 1 and a second clip 1' are fastened about the contacted elements to provide enhanced clasping. The machine for preforming this operation is somewhat different from the machine for forming one preformed clip about the contacted elements; however, many of the elements are the same or nearly the same and their relationships are the same. Where, in this second embodiment of the invention, the same or nearly the same element is used as shown in FIGS. 1 to 11, a prime (') or double prime (") will be used with the number to identify it with the original element number.

Figure 13:
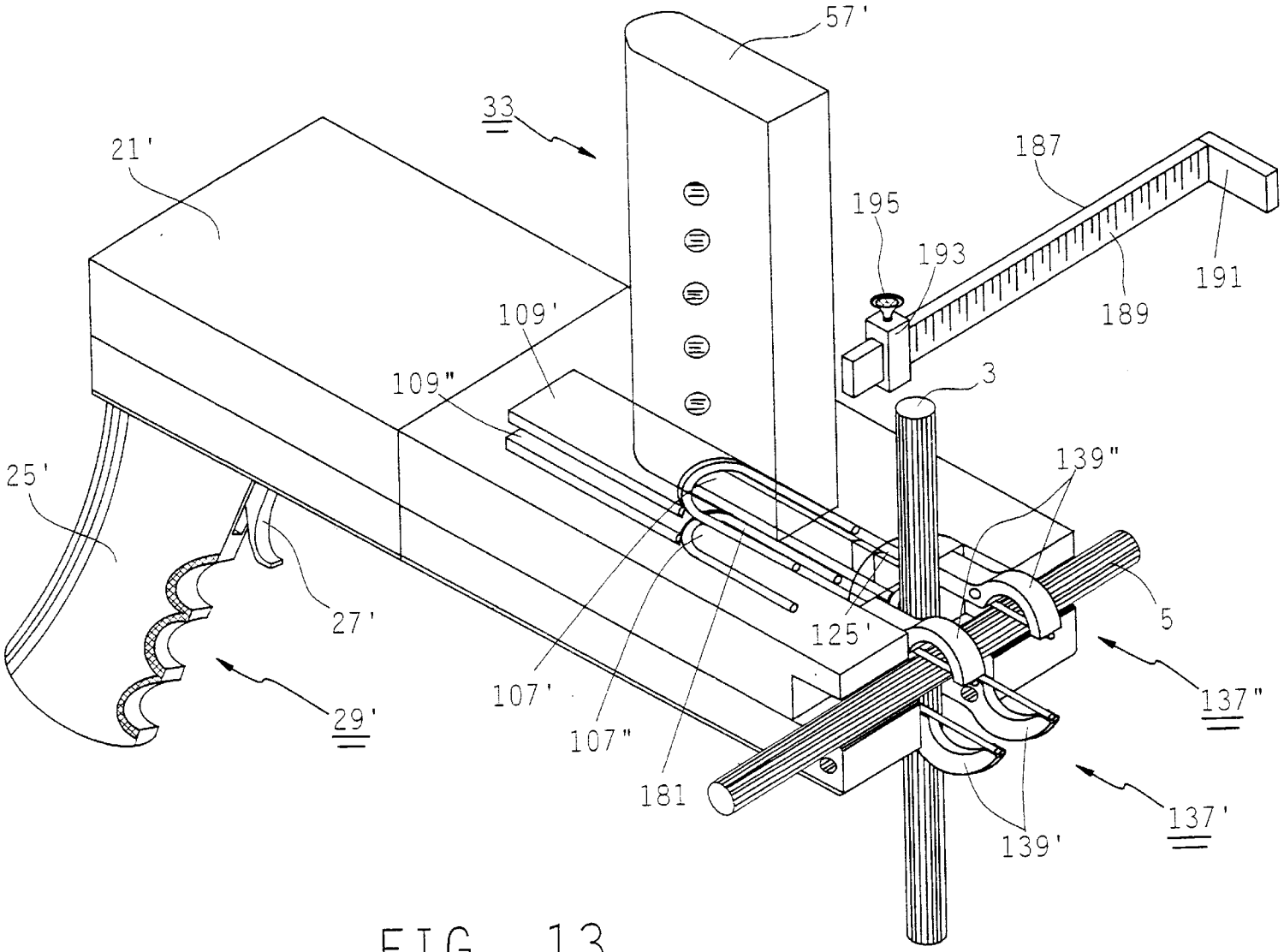
FIG. 13 is a perspective view, partly in phantom, of another embodiment of this invention, this embodiment for applying two clips to intersecting tubular members.
Figure 14:
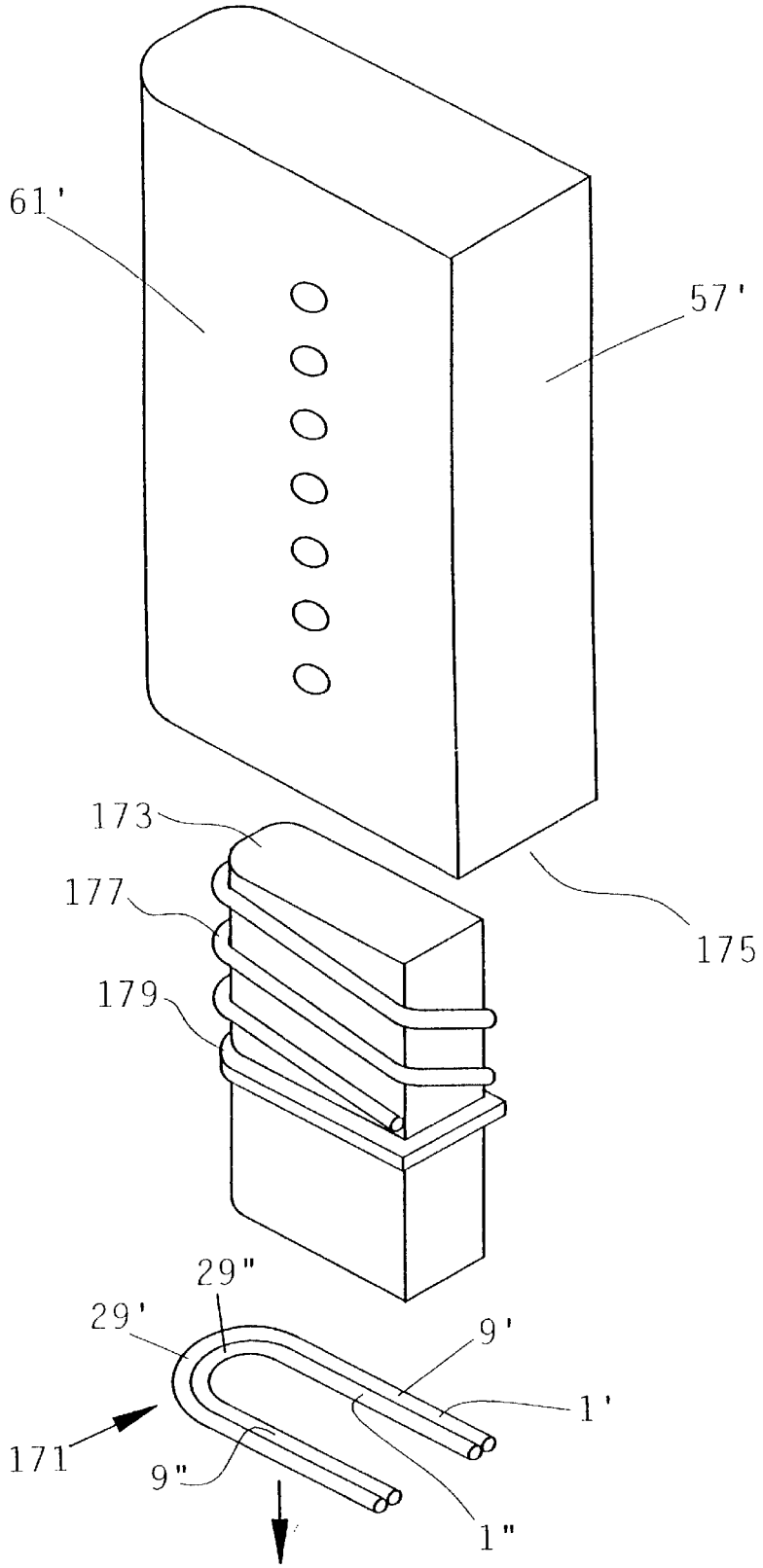
FIG. 14 is an exploded view of a magazine for holding and feeding a brace or pair of nestled clips to the machine when double clipping is required.

Such a machine is shown in FIG. 13 and is generally shown to comprise a machine housing 21', at least one handle 25' extending from said housing and at least one trigger 27'. A first means 29' for steadying the machine is shown to include a series of depressions 31'. A second means 33', including a magazine 57' is provided for feeding two preformed wire clips 1' and 1" at a time into housing 21'. As shown in FIG. 14, each preformed clip 1' and 1" is defined by a central concave bight area 29' and a pair of clip legs 9' extending substantially mutually parallel and outward from the respective bight areas; however, one clip is of larger size than the other and the two are nestled together in the magazine in a brace 171 that is shown in FIG. 14. Brace 171 comprises two clips 1' and 1" nestled together with their individual legs pointing in the same direction.

Figure 16:
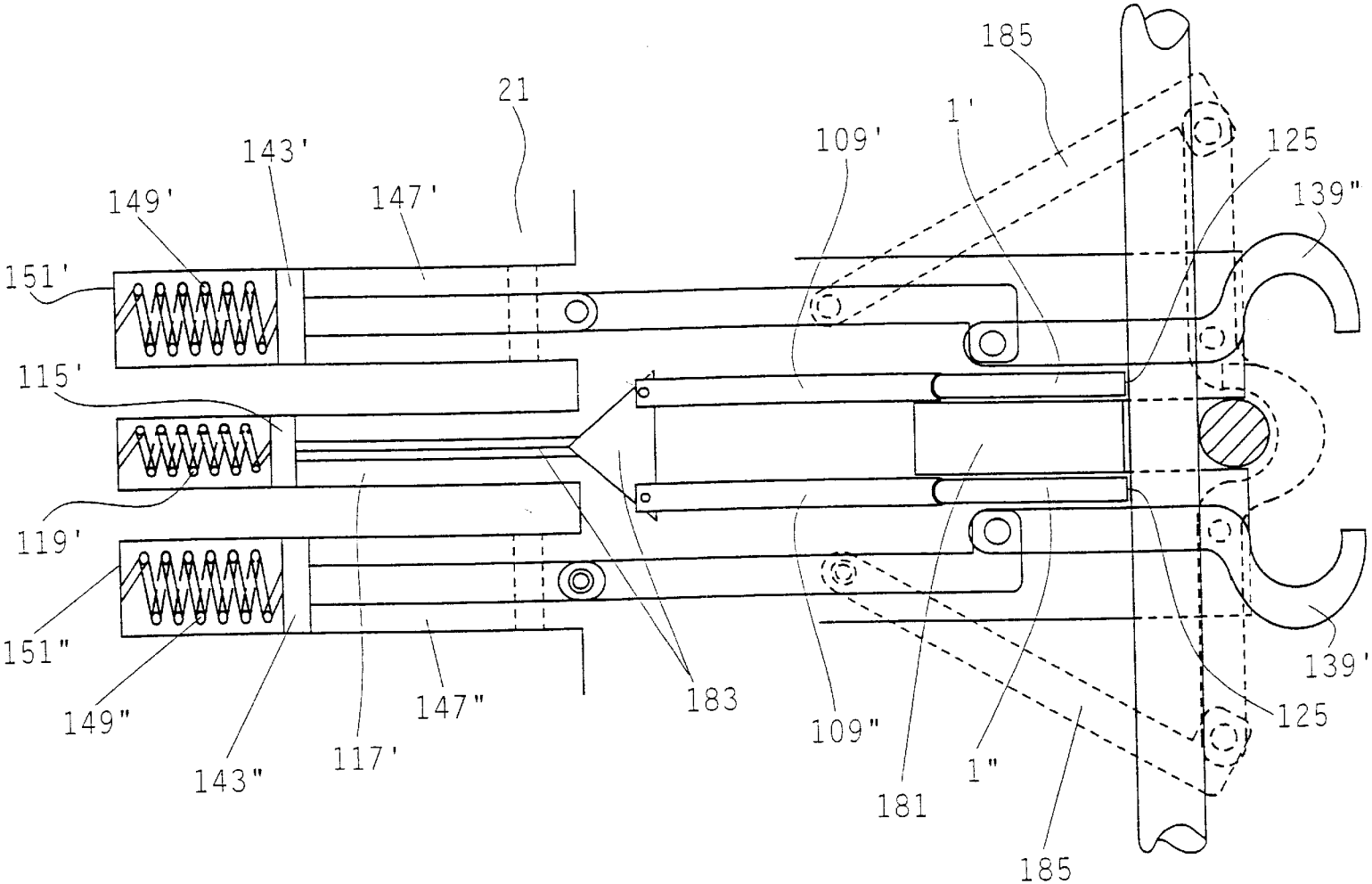

There is no bending site 53 in machine housing 21' in this embodiment because the clips are fed to the machine housing in a preformed configuration and do not require any further forming other than to be wrapped about horizontal tubular element 5'. There is, however, a charging location comprising two charging sites 107' and 107" for moving the clips into contact with posterior surface 7' of first tubular element 3', said clips 1' and 1" being vertically separated while in contact with posterior surface 7' a distance substantially equal to the thickness of horizontal tubular element 5'. This is shown in FIGS. 13, 15*b* and 16. There are also two fourth means 137' and 137" for deforming the clips about horizontal tubular element 5'.

Again, machine housing 21' is small and light enough to be manipulated by one hand. Also, at least one handle 25' extends downward and away from machine housing 21' so that machine housing 21' is balanced above handle 25' when in use. Further, trigger 27' is pivotally mounted to one of handles 25' for operative movement by a finger of the hand that holds the handle during use. While only one handle 25' and only one trigger 27' is shown in the drawings, it is specifically contemplated in this invention that other handles 25' could be attached to machine housing 21', such as that shown in FIG. 11 in phantom, and trigger 27' could be attached to that second handle.

Magazine 57' is shown in FIG. 14 to comprise a magazine housing 61' and an interiorly mounted spacing block 173 forming an annular space 175 therebetween for stacking braces 171 of clip doublets (1' and 1") therein. A spring 177 surrounds spacing block 173 and urges a ring 179, slidingly mounted about spacing block 173, downward against the stack of clip doublets (1' and 1") to urge them into the top of machine housing 21'.

In this embodiment, third means 105', for moving the U-shaped clips 1' and 1" out of machine housing 21' and bringing said respective concave bight areas 29' and 29" thereof into contact with the posterior surface of the first vertically oriented tubular element, comprises two separate charging sites 107' and 107" that, as shown in FIGS. 13 and 15*b*, are vertically separated, one above the other a distance equal to the vertical width of second horizontal tubular member 5. As brace 171 is fed from magazine 57' into machine housing 21', the upper charging site 107' catches the wider legs 9 of clip 1' and allows it to become aligned in its own channel 113', while the narrower clip 1" passes or drops through an aperture 181 in channel 111 to its own lower charging site 107" with its channel 113" where the legs 9" of clip 1" are captured. This arrangement sets both clips in mutually parallel position in machine housing 21', one above the other a distance equal to the width of the horizontal tubular element 5', and both facing forward toward the front of housing 21'. The vertical distance between upper charging site 107' and lower charging site 107" is set to the vertical thickness of second horizontally arranged tubular element 5.

Each charging site 107' and 107" has provided therewith a charging bar 109' and 109", that is preferably connected by links 183 driven by a single piston 115' housed in a bore 117'. A return spring 119' is located in bore 115' to facilitate return of piston 115' after the stroke of piston 115' charging the two clips 1' and 1" out through the front of machine housing 21' and into contact with the posterior surface of first tubular vertical element 3'.

There are two fourth means, 137' and 137", for bending legs 9 of each clip 1' and 1" about the anterior surface of second horizontal tubular element 5 to clasp both first and second tubular elements tightly together. In this embodiment, however, one clip is fastened in spaced-apart arrangement, one passing over top of horizontal tubular member 5' and the other passin(under said member. The first of these fourth means 137' preferably includes a pair of bending forks 139' pivotally mounted on a split pin 141' located in or exterior to machine housing front panel or surface 43'. Forks 139' and pins 141' are arranged in mutual spaced-apart configuration, one on each side of aperture 125', and are adapted to rotate upward toward machine housing top panel 47'. Forks 139' may be adjustable on pin 137' to pass along and adjacent to the opposite sides of vertical tubular members (rebars) of different diameters.

The second of the fourth means 137" preferably includes a similar pair of bending forks 139" pivotally mounted on a similar split pin 141" located in or exterior to machine housing front panel or surface 43' spaced above first pair of fourth means 137' (bending forks 139') and split pin 137' and outboard, and preferably adjacent to, forks 139'. Forks 139" and pins 141" are arranged in mutual spaced-apart configuration, one on each side of aperture 123', and are adapted to rotate downward and over second horizontal tubular element 5. Forks 139" may also be adjustable on pins 141" to pass along and spaced-apart from the opposite sides of vertical rebars of different diameters. The product of the double clips 1' and 1" are that one of clips 1' or 1" is fastened adjacent to the sides of vertical tubular element 3 while the other clip 1" or 1' passes outside the first clip and yet is still fastened about horizontal tubular element 5.

As shown in FIG. 16, forks 139' and forks 139" are adapted to pivot about their respective pins, one upward and the other downward, about posterior surface 13, one above and the other below first vertical tubular element 5, and deform legs 9' and 9" of clips 1' and 1" about the anterior surface 15 of second, horizontal tubular element 5. These pivoting actions are preferred to be powered by either separate pistons 143' and 143" or a single piston. As shown in FIG. 16, two pistons 143' and 143" are provided and connected to both pairs of forks 139' and 139" by arms 185. Pistons 143' and 143" are housed in bores 147' and 147" formed in machine housing 21'. It is further preferred that return springs 149' and 149" be attached between the pistons and the far ends 151' and 151" of bore 147' and 147" so that when power, such as in the form of compressed air, high pressure hydraulic fluid or electricity is removed from the driver of the pistons in the bores, the springs will draw the pistons deep into the bores and simultaneously withdraw bending forks 139' and 139" to their original positions.

Bending forks 139' and 139" are defined, as is set forth with respect to forks 135, by first and second distal ends 153'/155'/-153"/155" and have action surfaces 157' and 157" formed therebetween. Action surfaces 151' and 151" each comprise a centrally located arcuate saddle 159' and 159", of a radius r' and r" the same as the radius of second tubular element 5. Arcuate saddles 159' and 159" are arranged to pivot into contact with the anterior surface of second, horizontal tubular element 5 and bend legs 9' of clip 1' into full contact therewith. To aid in retaining legs 9 centrally on first and second distal ends 153 and 155, it is preferred to form single, small depressions 161 longitudinally along said distal ends as shown in FIG. 6*b*.

It is preferred that both pairs of bending forks be driven simultaneously about their respective pivot pins mounted in said front surface of machine housing 19'. However, movement of the first set of forks and the second set of forks can be done independently from each other, such as in consecutive motion, and this is fully comprehended in this invention. Such consecutive and independent motion would, of course, require separate pistons, housed in separate bores formed in the machine body, to be used to drive each pair of forks. Where separate pistons are used, it is preferred if the bores housing these pistons be arranged parallel to each other in machine housing 21'.

Also, as in the first embodiment of this invention, it is preferred to include a depressible pin reciprocally mounted in machine housing 21', to activate the machine when said machine comes into contact with one of the vertical tubular elements and to deactivate the machine when it is not in contact with it.

In another embodiment of this invention, a spacer 187 is provided, as shown in FIG. 13, for spacing out vertical rebars and the like during use of the invention. Spacer 187 comprises an elongated element 189 containing measuring indicia as shown terminated at its far end by a forwardly directed spacer bar 191 and temporarily held fast to machine housing 21' by a fixture 193 having a slot formed therethrough for receipt of bar 191 and a thumb screw 195 for tightening against said bar 191. This spacer 187 is used to measure the side-to-side distance between vertical tubular elements when the horizontal elements have been established and the tubular structure is being constructed. By changing the operative length of elongated element 189 in fixture 193, different side measurements may be established with accuracy.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the way to achieve substantially the same result are within the scope of this invention.

What is claimed is:

1. A machine for applying a metal wire clip to intersecting first and second tubular elements arranged in vertical and horizontal configuration, comprising:

a) a machine housing, a handle extending from said housing and a trigger and first means for steadying said machine;

b) second means for feeding wire clips, one-at-a-time, into said machine housing so that the clips repose therein in as U-shaped clips defined by a central concave bight area and a pair of clip legs extending substantially mutually parallel and outward from said bight area;

c) third means for moving the clip into contact with the posterior surface of the first tubular element; and, d) fourth means for bending the legs upward about the second horizontal tubular element to clasp both first and second tubular elements tightly together.

2. The machine of claim 1 wherein said machine housing is small and light enough to be manipulated by one hand.

3. The machine of claim 1 wherein said handle extends downward and away from said machine housing so that said machine is balanced above said handle when in use.

4. The machine of claim 1 wherein said first means is mounted in said handle.

5. The machine of claim 4 wherein said first means for steadying said machine housing during use includes depressions formed in said handle for partial receipt therein of portions of the user's fingers during holding of said handle.

6. The machine of claim 1 wherein said trigger is pivotally mounted to said handle for operative movement by a finger of the hand that holds said machine during use.

7. The machine of claim 1 further including a hanger attached to said machine housing for temporarily steadying said machine against the tubular elements during application of the clips.

8. The machine of claim 7 wherein said fourth means includes a pair of bending forks pivotally mounted exterior said housing for temporary receipt therein of a portion of the legs of the U-shaped clip, said forks adapted to pivot, one on each side of the first vertical tubular element, and bend the legs of the clip about the anterior surface of the second, horizontal tubular element.

9. The machine of claim 8 wherein said bending forks are defined by first and second distal ends and have an action surface formed therebetween, said action surface comprising a centrally located arcuate saddle of a radius substantially the same as that of the second tubular element.

10. The machine of claim 9 further including single small depressions formed longitudinally on said distal ends of said bending forks for urging the position of the legs of the clip to remain centralized in said forks as the legs are bent about the anterior surface of the second tubular element.

11. The machine of claim 9 wherein said bending forks are driven simultaneously about pivot pins.

12. The machine of claim 11 wherein said forks are driven together in pivotal motion about said pins by a piston housed in a bore formed in said machine body.

13. The machine of claim 12 further including a return spring attached to said piston hand housed in said bore to withdraw said piston at an end of its stroke.

14. The machine of claim 13 wherein said return spring is housed in said bore.

15. The machine of claim 12 wherein said first means and said bending forks are driven by separate pistons housed in separate bores formed in said machine body and said separate bores are arranged parallel to each other in said machine housing.

16. The machine of claim 12 wherein said second means and said bending forks are driven by separate pistons housed in separate bores formed in said machine body and said separate bores are arranged parallel to each other in said machine housing.

17. The machine of claim 12 wherein said bending forks are driven by separate pistons housed in separate bores formed in said machine body and said separate bores are arranged parallel to each other in said machine housing.

18. The machine of claim 1 further including a spacer to measure the side distance between vertical tubular members.

19. The spacer of claim 18 wherein said spacer comprises:

a) an elongated element containing measuring indicia extending outward from said machine housing;

b) a spacer bar affixed to the distal end of said element as a guide for spacing said housing from the nearest vertical element; and, c) a fixture mounted on said machine housing for receipt of said elongated element therein in temporary fixed position therein to set the distance said spacer bar reposes from said housing.

20. A machine for applying a metal wire clip to intersecting first and second tubular elements arranged in vertical and horizontal configuration, respectively, comprising:

a) a machine housing including spaced-apart front and rear, top and bottom and side surfaces, a handle extending from said bottom surface and a trigger arranged for operable movement with said handle;

b) first means for steadying said machine during use;

c) second means for feeding U-shaped clips, each clip defined by a central concave bight area and a pair of legs extending substantially mutually parallel and outward from said bight area, from a magazine into a charging site located in said machine housing;

c) third means for moving the U-shaped clip out of said charging site, through said front surface of said machine housing and bringing the concave bight area of the clip into contact with the posterior surface of the first vertically oriented tubular element, and arranging said legs to extend from said bight area across the width of both first and second elements; and, e) fourth means, for bending the legs about the anterior surface of the second horizontal tubular element to clasp both first and second tubular elements tightly together.

21. The machine of claim 20 wherein said third means includes a charging bar substantially the thickness of a clip so that only one clip can repose in said charging site at any one time for charging outward against the posterior surface of the first, vertical tubular element.

22. The machine of claim 21 wherein said charging bar is reciprocally mounted for movement rearward, after a stroke that moves the clip out of said charging site, and said reciprocal motion is produced by a piston housed in a bore formed in said machine body.

23. The machine of claim 22 further including a return spring engaging said charging bar and arranged to move said bar rearward, after its forward stroke.

24. The machine of claim 22 further including a return spring engaging said charging bar and arranged to move said bar rearward, away from said charging site, after the clip has been moved into contact with the vertical tubular element and wherein said return spring is attached to said piston and to said machine housing and housed inside said bore formed in said machine body.

25. The machine of claim 20 wherein said charging site is defined by a channel having side walls that include a first area wherein said side walls are spaced wider apart than the width of the U-shaped clip to eliminate any slight deviation in the parallelism of the legs of the clip from jamming the movement of the U-shaped clip into said charging site.

26. The machine of claim 25 further including a second area, interposed said first area and said front surface of said machine housing, including narrowing side walls that divert the clip back into said channel at a gradual angle, to squeeze the legs of the U-shaped clip toward each other and into parallelism on their way through the rest of said channel and into contact with the posterior surface of the first vertically oriented tubular element.

27. The machine of claim 20 wherein said fourth means, for bending the legs about the anterior surface of the second tubular element, includes a pair of bending forks pivotally mounted exterior said housing for temporary receipt therein of a portion of the legs of the clip, said forks adapted to pivot, one on each side of the first vertical tubular element and bend the legs of the clip about the anterior surface of the second, horizontal tubular element.

28. The machine of claim 27 wherein said bending forks are defined by first and second distal ends and have an action surface formed thereon, said action surface including a centrally located arcuate saddle substantially the radius of the tubular element about which said legs of the clip are bent.

29. The machine of claim 28 further including single small depressions formed centrally and longitudinally on said distal ends of said forks for urging the position of the legs of the clip to remain centralized in said bending forks as the legs of the clip are deformed about the anterior surface of the second tubular element.

30. The machine of claim 28 wherein said bending forks are driven simultaneously about pivot pins mounted in said front surface of said machine housing.

31. The machine of claim 28 wherein said bending forks are driven together in pivotal motion by a piston housed in a bore formed in said machine body.

32. The machine of claim 31 further including a return spring attached to said piston.

33. The machine of claim 32 wherein said return spring is housed in said bore.

34. The machine of claim 20 further including a depression formed in said front surface of said machine housing for temporary receipt therein of the posterior surface of the first vertically oriented tubular element.

35. The machine of claim 20 further including a pair of hangers at said front machine housing face for temporarily hanging over the horizontal second tubular element to help support said machine during its use.

36. A machine for applying a pair of metal wire clips to intersecting first and second tubular elements arranged in vertical and horizontal configuration, comprising:

a) a machine housing, at least one handle extending from said housing and a trigger, a means for steadying said housing;

b) a magazine for feeding two, pre-formed wire clips, each clip defined by a central concave bight area and a pair of clip legs extending substantially mutually parallel and outward from said bight area, one clip of larger size than the other, into said machine housing so that the clips repose therein with their individual legs pointing in the same direction;

c) means for moving the clips into contact with the posterior surface of the first tubular element, said clips being vertically separated a distance substantially equal to the thickness of the horizontal tubular element; and, d) means for bending the pairs of legs of each clip in a different direction about the second horizontal tubular element to clasp both first and second tubular elements tightly together.

37. The machine of claim 36 wherein said machine housing is small and light enough to be manipulated by one hand.

38. The machine of claim 36 wherein said at least one handle extends downward and away from said machine housing so that said machine is balanced above said at least one handle when in use and said trigger is pivotally mounted to one of said at least one handles.

39. The machine of claim 36 further including a pin, reciprocally mounted in said machine housing, to activate said machine when said machine comes into contact with one of the tubular elements and to deactivate said machine when said machine is not in contact with one of the tubular elements.

40. A machine for applying a pair of metal wire clips to intersecting first and second tubular elements arranged in vertical and horizontal configuration, respectively, comprising:

a) a machine housing, a handle extending from said housing, first means for steadying said housing during use, and a trigger;

b) second means for feeding two U-shaped clips, each defined by a central concave bight area and a pair of legs extending substantially mutually parallel and outward from said bight area, to a charging location internal said machine housing;

c) third means for moving the U-shaped clips out of said charging location in said machine housing, bringing said respective concave bight areas thereof into contact with the posterior surface of the first vertically oriented tubular element, said clips being vertically separated a distance substantially equal to the thickness of the horizontal tubular element; and arranging said legs to extend across the width of both first and second tubular elements, respectively, over and under the second element; and, e) fourth means, for bending the pairs of legs of each clip in opposite directions about the anterior surface of the second horizontal tubular element to clasp both first and second tubular elements tightly together.

41. The machine of claim 40 wherein said second means for feeding a pair of U-shaped clips to a charging location internal said machine housing includes a magazine, for temporary attachment to said machine housing, that holds a supply of the clips, each clip of one of two different sizes, with one clip narrower than the other, each pair of one of each size nestled together in a single brace, the narrower one inside the wider one, for feeding the clips in single braces to the charging location.

42. The machine of claim 41 wherein said charging location comprises:

a) an upper charging site and a lower charging site, one above the other in mutual spaced-apart arrangement, each site including a channel dimensioned to receive therein one of the clips from the brace of clips charged to said charging location;

b) a charging bar located in each said channel; and, c) means for moving each said charging bar in said channels to move each of the clips located in said respective channel outward said housing and into contact with the posterior surface of the first vertically oriented tubular element.

43. The machine of claim 42 wherein said charging bars move in separate channels located under said magazine and into which a brace of deformed U-shape clips pass from said magazine and separate with the narrower of the clips passing to the lower charging site.

44. The machine of claim 40 wherein said third means for moving the U-shaped clips out of said machine housing, bringing said respective concave bight areas thereof into contact with the posterior surface of the first vertically oriented tubular element, includes two charging bars, each housed in its own charging channel, for reciprocal movement forward and rearward in said housing wherein said reciprocal motion is produced by a piston, housed in a bore formed in said machine body.

45. The machine of claim 44 further including a return spring attached to said piston and to said machine housing and housed inside said bore formed in said machine body and arranged to move said charging bars rearward, away from the posterior surface of the first vertically oriented tubular element, after the clips have been placed in contact with the tubular element and deformed about the horizontal tubular element.

46. The machine of claim 40 wherein said fourth means includes a first pair of bending forks in spaced-apart arrangement, pivotally mounted at least partially exterior said housing for temporary receipt therein of a portion of the legs of the narrow U-shaped clip, said forks adapted to pivot, one on each side of the first vertical tubular element and bend the legs of the clip about the anterior surface of the second, horizontal tubular element.

47. The machine of claim 46 wherein said fourth means includes a second pair of bending forks in spaced-apart arrangement, pivotally mounted at least partially exterior said housing and outside said first pair of said bending forks for temporary receipt therein of a portion of the legs of the wider U-shaped clip, said second pair of bending forks adapted to pivot, one on each side of the first, vertical tubular element and bend the legs of the wider clip about the anterior surface of the second, horizontal tubular element in a direction opposite from the bend of the legs of the narrower clip.

48. The machine of claim 46 wherein said bending forks are defined by first and second distal ends and have an action surface formed therebetween, said action surface comprising a centrally located arcuate saddle of a radius the same as that of the second tubular element.

49. The machine of claim 46 further including single small depressions formed longitudinally on said distal ends of said bending forks for urging the position of the legs of the clip to remain centralized in said forks as the legs are bent about the anterior surface of the second tubular element.

50. The machine of claim 46 wherein said bending forks are driven simultaneously about pivot pins mounted in said front surface of said housing.

51. The machine of claim 46 wherein said forks are driven together in pivotal motion about said pins by a piston housed in a bore formed in said machine body.

52. The machine of claim 51 further including a return spring attached to said piston hand housed in said bore.

53. The machine of claim 52 wherein said return spring is housed in said bore.

54. The machine of claim 46 wherein said third means and said bending forks are driven by separate pistons housed in separate bores formed in said machine body and said separate bores are arranged parallel to each other in said machine housing.

55. The machine of claim 46 wherein said third means and said bending forks are driven by separate pistons housed in separate bores formed in said machine body and said separate bores are arranged parallel to each other in said machine housing.

56. The machine of claim 46 wherein said third means and said fourth means are driven by separate pistons housed in separate bores formed in said machine body and said separate bores are arranged parallel to each other in said machine housing.

57. The machine of claim 40 wherein said fourth means includes a second pair of bending forks in spaced-apart arrangement, pivotally mounted at least partially exterior said housing for temporary receipt therein of a portion of the legs of the wider U-shaped clip, said forks adapted to pivot, one on each side of the first, vertical tubular element and bend the legs of the clip about the anterior surface of the second, horizontal tubular element.

58. The machine of claim 57 wherein said bending forks are defined by first and second distal ends and have an action surface formed therebetween, said action surface comprising a centrally located arcuate saddle of a radius the same as that of the second tubular element.

59. The machine of claim 57 further including single small depressions formed longitudinally on said distal ends of said bending forks for urging the position of the legs of the clip to remain centralized in said forks as the legs are bent about the anterior surface of the second tubular element.

60. The machine of claim 57 wherein said bending forks are driven simultaneously about pivot pins mounted in said front surface of said housing.

61. The machine of claim 57 wherein said forks are driven together in pivotal motion about said pins by a piston housed in a bore formed in said machine body.

62. The machine of claim 61 further including a return spring attached to said piston hand housed in said bore.

63. The machine of claim 62 wherein said return spring is housed in said bore.

64. The machine of claim 57 wherein said third means and said bending forks are driven by separate pistons housed in separate bores formed in said machine body and said separate bores are arranged parallel to each other in said machine housing.

65. The machine of claim 57 wherein said third means and said bending forks are driven by separate pistons housed in separate bores formed in said machine body and said separate bores are arranged parallel to each other in said machine housing.

66. The machine of claim 57 wherein said third means and said fourth means are driven by separate pistons housed in separate bores formed in said machine body and said separate bores are arranged parallel to each other in said machine housing.

67. The machine of claim 40 wherein said machine housing is defined by spaced-apart front and rear surfaces, spaced-apart side surfaces, and spaced-apart top and bottom surfaces and further include an area formed in said front surface of said machine housing for temporary receipt therein of the posterior surface of the first vertically oriented tubular element.

68. The machine of claim 40 further including a pin, reciprocally mounted in said machine housing, to activate said machine when said machine comes into contact with one of the tubular elements and to deactivate said machine when said machine is not in contact with one of the tubular elements.

* * * * *